US008771914B2

(12) United States Patent
Kotsugai et al.

(10) Patent No.: US 8,771,914 B2
(45) Date of Patent: Jul. 8, 2014

(54) TONER FOR DEVELOPING LATENT ELECTROSTATIC IMAGE, TWO-COMPONENT DEVELOPER, IMAGE FORMING METHOD AND IMAGE FORMING APPARATUS

(75) Inventors: Akihiro Kotsugai, Numazu (JP); Hiroshi Yamashita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 1197 days.

(21) Appl. No.: 12/049,686

(22) Filed: Mar. 17, 2008

(65) Prior Publication Data

US 2008/0233496 A1 Sep. 25, 2008

(30) Foreign Application Priority Data

Mar. 23, 2007 (JP) ..... 2007-077503
Jan. 11, 2008 (JP) ..... 2008-004818

(51) Int. Cl.
*G03G 15/01* (2006.01)

(52) U.S. Cl.
USPC ..... 430/110.1; 430/111.3; 430/108.1

(58) Field of Classification Search
CPC ..... G03G 9/00; G03G 9/08; G03G 9/0802; G03G 9/0821; G03G 9/0825; G03G 9/0827
USPC ..... 430/111.3, 108.1, 110.1; 399/111
See application file for complete search history.

(56) References Cited

U.S. PATENT DOCUMENTS 5,219,697 A * 6/1993 Mori et al. ..... 430/110.3
5,272,037 A * 12/1993 Ohtani et al. ..... 430/111.3
5,541,031 A * 7/1996 Yamashita et al. ..... 430/129
7,198,874 B2 4/2007 Saito et al.
7,214,461 B2 5/2007 Yamashita et al.
7,294,443 B2 11/2007 Yamashita et al.
7,318,989 B2 1/2008 Kotsugai et al.
2002/0025184 A1* 2/2002 Ishikawa et al. ..... 399/111
2003/0096185 A1 5/2003 Yamashita et al.

(Continued)

FOREIGN PATENT DOCUMENTS

JP 4-211273 8/1992
JP 2537503 7/1996

(Continued)

OTHER PUBLICATIONS

Office Action issued Feb. 14, 2012, in Japanese Patent Application No. 2008-004818.

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

The present invention provides a toner which, despite its spherical shape, makes it possible to prevent an external additive from being embedded in the toner easily or by a load generating low stress, reduce variation in image density, maintain cleaning ability and transfer ability throughout its long-term use and obtain excellent image quality, and further, provides a two-component developer, an image forming method and an image forming apparatus with the use of the toner. There is a toner including: base particles including a colorant and a resin, and hard fine particles, wherein the base particles and the hard fine particles are mixed together, and protruding portions formed of fine organic resin particles which are different in composition from a resin contained as a main component in the base particles are provided on surfaces of the base particles.

7 Claims, 6 Drawing Sheets

(56) References Cited

U.S. PATENT DOCUMENTS

| | | | | |
|---|---|---|---|---|
| 2005/0170271 | A1* | 8/2005 | Yamanami et al. | 430/65 |
| 2006/0063081 | A1 | 3/2006 | Nagatomo et al. | |
| 2006/0068312 | A1 | 3/2006 | Yamashita et al. | |
| 2006/0127788 | A1 | 6/2006 | Yamashita et al. | |
| 2006/0172215 | A1 | 8/2006 | Kotsugai et al. | |
| 2006/0177756 | A1 | 8/2006 | Sugimoto et al. | |
| 2006/0204883 | A1 | 9/2006 | Nakayama et al. | |
| 2006/0240349 | A1* | 10/2006 | Watanabe et al. | 430/108.4 |
| 2006/0240351 | A1* | 10/2006 | Sugiura et al. | 430/108.11 |
| 2007/0015077 | A1 | 1/2007 | Yamashita et al. | |
| 2007/0031752 | A1 | 2/2007 | Watanabe et al. | |
| 2007/0059063 | A1 | 3/2007 | Nakayama et al. | |
| 2007/0141506 | A1* | 6/2007 | Inoue et al. | 430/137.15 |
| 2007/0184370 | A1 | 8/2007 | Yamashita et al. | |
| 2007/0190444 | A1 | 8/2007 | Kotsugai et al. | |
| 2007/0275315 | A1 | 11/2007 | Nagatomo et al. | |
| 2008/0166156 | A1* | 7/2008 | Kawase | 399/222 |

FOREIGN PATENT DOCUMENTS

| | | |
|---|---|---|
| JP | 9-43909 | 2/1997 |
| JP | 2000-292978 | 10/2000 |
| JP | 2004-86131 | 3/2004 |
| JP | 2004-246344 | 9/2004 |
| JP | 2005-55534 | 3/2005 |

* cited by examiner

TONER FOR DEVELOPING LATENT ELECTROSTATIC IMAGE, TWO-COMPONENT DEVELOPER, IMAGE FORMING METHOD AND IMAGE FORMING APPARATUS

BACKGROUND OF THE INVENTION

1. Field of the Invention

The present invention relates to a toner for developing latent electrostatic images and to a two-component developer, an image forming method and an image forming apparatus that use the same.

2. Description of the Related Art

In an electrophotographic apparatus or electrostatic recording apparatus, a toner is attached to a latent electrostatic image formed on a photoconductor, the toner-attached image is transferred onto a transfer material, then the toner is thermally fixed onto the transfer material to yield a toner image. In full-color image formation, in general, colors are reproduced using toners of four colors, i.e. black, yellow, magenta and cyan, and a full-color image is obtained by developing each color, simultaneously heating toner layers deposited on top of one another over a transfer material and fixing the toner layers. However, from the point of view of users who are familiar with printed materials, images produced by full-color copiers are still not satisfactory, and further improvement in image quality is demanded to achieve the high definition and high resolution of photographs and printed materials.

Conventionally, electric or magnetic latent images are visualized by toners. It is known that toners which are small in particle diameter and which have a narrow particle size distribution are used for improving the quality of electrophotographic images. Such toners are colored particles formed by adding a colorant, a charge control agent and other additives into binder resins, and methods for producing the toners are broadly divided into pulverization method and polymerization method. In the pulverization method, a toner is produced as follows: a colorant, a charge control agent, an anti-offset agent and the like are melted and mixed in a thermoplastic resin in such a manner as to be evenly dispersed, and the composition obtained is pulverized and classified.

The pulverization method is known to be capable of producing toners with fairly superior properties; however, selection of materials for the toners is limited. For example, compositions obtained through melting and mixing need to be able to be easily pulverized and classified by apparatuses. This demand requires compositions obtained through melting and mixing to be sufficiently brittle. For this reason, when the compositions are actually pulverized into particles, it is likely that a wide particle size distribution is created, and if an attempt is made to obtain copied images having excellent resolution and gray-scale properties, it is necessary to remove fine powders that are 5 μm or less in particle diameter and coarse particles that are 20 μm or greater in particle diameter through classification; hence, the pulverization method is disadvantageous in that the yield is very low. Also in the pulverization method, it is difficult for the colorant, the charge control agent and the like to be evenly dispersed in the thermoplastic resin. Uneven dispersion of additives has negative effects on the fluidity, image-developing properties and durability of the toners, image quality and the like.

In recent years, in order to solve these problems in the pulverization method, an invention concerning a suspension polymerization process has been disclosed, for example (Japanese Patent Application Laid-Open (JP-A) No. 09-43909). Also, there has been disclosed an invention concerning a process of effecting association amongst fine resin particles obtained by emulsion polymerization and thusly obtaining toner particles having indefinite shapes (Japanese Patent (JP-B) No. 2537503). Such polymerization toners are closer to spheres in particle shape than pulverized toners are, and ingredients are expected to be homogenized, so that they are superior in reproducing images. However, there is a new problem created in which the presence state of external additives such as a fluidity-adding agent typified by silica is liable to change on surfaces of particles.

It is inferred that the problem is due to the following. Since the surfaces of the toners are smooth and superior in packing properties, the toners have a larger number of contact points, and so the external additives will be easily embedded in the toners at the contact points between the toners or at the contact points between the toners and other members. As a method for solving such problems, there is a process of mixing fine resin particles having relatively large diameters or the like with particles.

Also, there has been disclosed an invention concerning a process of not only adding high-molecular-weight fine resin particles into toner particles but also localizing the fine resin particles on the surfaces of the toner particles to improve offset resistance (JP-A No. 2000-292978). However, this invention cannot sufficiently prevent external additives from being embedded because the minimum fixing temperature rises, the low-temperature fixing properties, in other words the energy-saving image-fixing properties, are not sufficient, and the high-molecular-weight resin is a component of the toner particles, so that there is no significant change in the shape of particles.

BRIEF SUMMARY OF THE INVENTION

The present invention is designed in light of the problems in related art and aimed at providing a toner which, despite its spherical shape, makes it possible to prevent an external additive from being embedded in the toner easily or by a load generating low stress, reduce variation in image density, maintain cleaning ability and transfer ability throughout its long-term use and obtain excellent image quality, and further, providing a two-component developer, an image forming method and an image forming apparatus with the use of the toner.

The problems can be solved by the following means.

<Toner for Developing Latent Electrostatic Image>

(1) To use a toner for developing latent electrostatic images, including: base particles including a colorant and a resin, and hard fine particles, wherein the base particles and the hard fine particles are mixed together, and protruding portions formed of organic fine resin particles which are different in composition from a resin contained as a main component in the base particles are provided on surfaces of the base particles. (2) It is desirable that the protruding portions be dotted on the surfaces of the base particles, and (3) it is further desirable that the organic fine resin particles have a diameter which is equal to or less than ⅕ the average particle diameter of the toner and have hemispherical convex portions. (4) As to the toner for developing latent electrostatic images according to any one of (1) to (3), it is desirable that the protruding portions be formed by adding an organic solvent dissolving a toner composition including a prepolymer into an aqueous medium containing the organic fine resin particles, allowing the organic fine resin particles to be borne on a surface of an oil droplet of the organic solvent when the oil droplet is formed, and subjecting the organic fine resin particles on the surface of the oil droplet to one of elongation reaction and crosslinking reaction. (5) As to the toner for developing latent electrostatic images according to any one of (1) to (4), the following are preferable: the particles of the toner have an average sphericity E of 0.90 to 0.99; and/or the toner has a degree of circularity SF-1 of 100 to 150 and a degree of circularity SF-2 of 100 to 140; and/or the particles of the toner have a volume average particle diameter Dv of 2 μm to 7 μm, and the ratio Dv/Dn between the volume average particle diameter Dv and a number average particle diameter Dn is 1.25 or less.

<Two-Component Developer>

A two-component developer of the present invention is a two-component developer including: the toner, and a carrier composed of magnetic particles.

<Image Forming Method>

An image forming method of the present invention is an image forming method including: forming a toner image by developing a latent electrostatic image on an electrostatic image-bearing member with a developer, bringing a transfer unit into contact with a surface of the electrostatic image-bearing member via a transfer material, and electrostatically transferring the toner image onto the transfer material, wherein the developer is the two-component developer.

<Image Forming Apparatus>

An image forming apparatus of the present invention is an image forming apparatus including: a unit configured to form a toner image by developing a latent electrostatic image on an electrostatic image-bearing member with a developer, bring a transfer unit into contact with a surface of the electrostatic image-bearing member via a transfer material, and electrostatically transfer the toner image onto the transfer material, wherein the developer is the two-component developer.

DETAILED DESCRIPTION OF THE INVENTION

Figure 1:
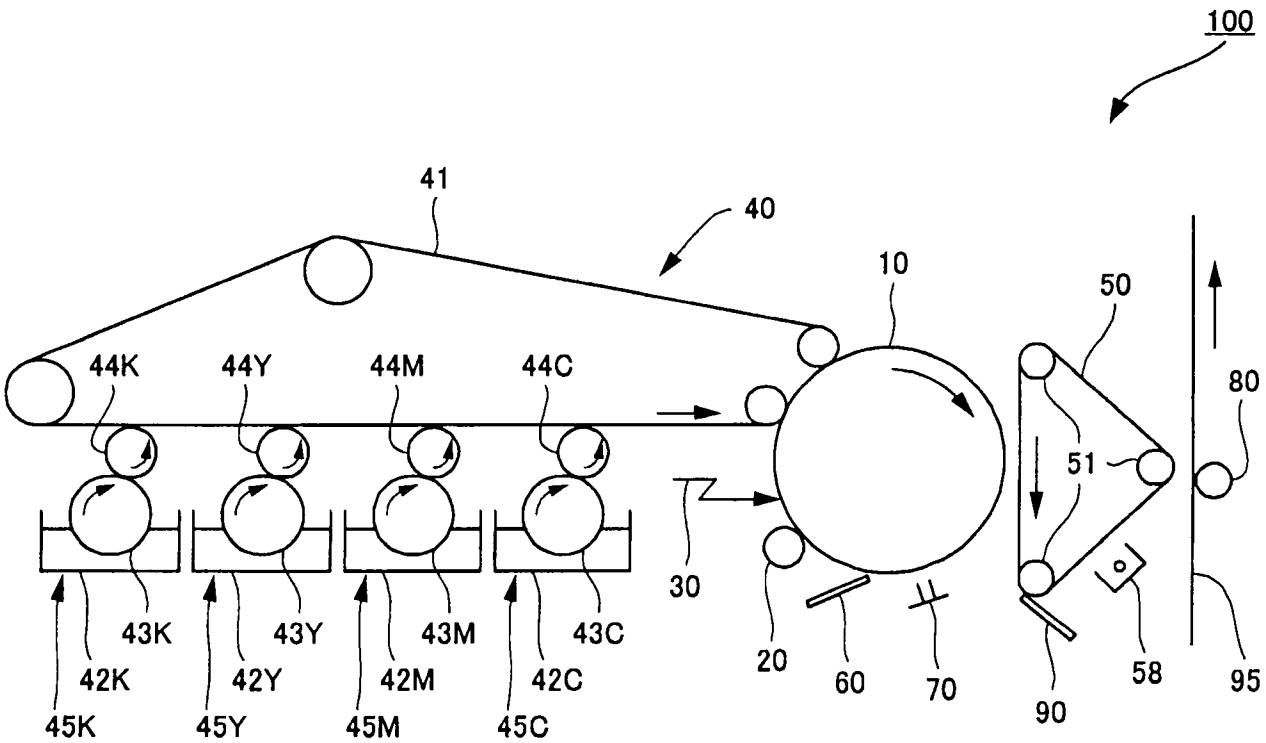
FIG. 1 is a schematic structural diagram showing one embodiment of a copier having an intermediate transfer member, used in the present invention.

The following delineates the present invention's toner, two-component developer, image forming method and image forming apparatus by means of embodiments and with reference to the drawings.

The toner of the present invention is characterized in that protruding portions are partially provided on surfaces of toner particles. Specifically, protruding portions formed of a resin component which is different in composition from a resin component constituting base particles of the toner are dotted on surfaces of toner particles. These protruding portions make it possible to prevent an external additive from being rapidly embedded in the toner throughout long-term use of the toner. It is appropriate that these protruding portions be dotted, being firmly affixed to surfaces of the base particles, and it is not desirable for them to be apart from the toner particles, as opposed to externally added fine particles, for example.

As a toner becomes more spherical, it is more likely that an external additive such as silica, used as an agent for giving fluidity to the toner, is embedded in a toner surface easily and by a load generating low stress. This is because while the toner is used, the toner surface is subject to forces such as friction, and so the external additive is embedded in the toner. Such a spherical toner is disadvantageous in the following respect: whole surfaces of toner particles are uniformly subject to forces generated by contact between the surfaces and members such as a carrier, an stirring member and a controlling blade, so that the external additive is rapidly and uniformly embedded therein, and thus the fluidity of the toner is liable to vary dramatically soon after the toner starts being used.

Meanwhile, in the case of irregularly-shaped particles typified by pulverized toner, since surfaces of toner particles and the aforementioned members do not come into contact with each other as uniformly as in the case of spherical particles, the fluidity of the toner varies relatively moderately; however, there are many troubles in terms of image quality, owing to uneven attachment of the particles, for example. Accordingly, it is desirable that a toner be substantially spherical. It should be noted that provision of protruding portions on surfaces of toner particles makes it possible to prevent an external additive from being rapidly and uniformly embedded in the toner, reduce variation in the fluidity of the toner and maintain excellent image quality throughout long-term use of the toner.

It is appropriate that the protruding portions on the surfaces of the toner particles be formed of organic fine resin particles which are different in composition from a resin contained as a main component in the toner. This is because the protruding portions can be prevented from being embedded in the particles when the toner is used, and also the protruding portions can be easily formed when a variety of polymerization toners are produced. Typically, it is desirable that the base particles be mainly formed of polyester and that the protruding portions be formed of a resin which is different in composition from polyester, typified by styrene-acrylic resin, particularly a thermoplastic resin able to be used as a binder resin for the toner.

Thus, the external additive can be prevented from being embedded in the toner, without affecting the image-fixing properties of the toner, etc. For example, in a suspension polymerization process in which a monomer including a colorant, a charge control agent, a releasing agent and the like that are components of a toner is suspended in an aqueous medium, and particles are formed by polymerizing this monomer, it is desirable that toner particles be formed, with the organic fine resin particles or a raw material thereof previously mixed into the monomer or dispersion medium.

In the case where particles are produced by flocculating and combining particles including a resin, a colorant, a releasing agent and the like in an aqueous medium, it is possible to deposit the organic fine resin particles over a toner surface by flocculating the fine organic resin particles simultaneously with the particles or by making the organic fine resin particles or a raw material thereof coexist with the particles at a late stage of the flocculating and combining process.

In the case where particles are produced by dissolving or melting compositions such as a colorant and a releasing agent and a resin composition and then suspending these compositions in an aqueous medium, it is advisable to make the organic fine resin particles or a raw material thereof present in the resin composition or in the aqueous medium and then make the organic fine resin particles present on a toner surface in the particle producing step.

Also, in a particle producing method in which a prepolymer including a colorant and a releasing agent and a prepolymer that is reactive with the prepolymer are dissolved or dispersed in a nonaqueous organic solvent, this solution or dispersion solution is suspended in an aqueous medium, and the molecular weight is controlled by a reaction between the prepolymers in the suspension, any one of the following processes is preferably employed: a process of making the organic fine resin particles or a raw material thereof present in the nonaqueous solvent, and a process of making the fine organic resin particles or a raw material thereof present in the aqueous medium and attaching the foregoing to surfaces of particles. In these processes, the fine organic resin particles or the raw material thereof is present in the nonaqueous solvent or the aqueous medium and deposited over an oil-water interface when a state of suspension is produced.

It is desirable that the protruding portions be substantially hemispherical. This is because substantially hemispherical shapes can be easily formed by partially embedding a fine particle component which is different from the toner particles, in the surfaces of the toner particles.

Also, it is desirable that the protruding portions have a diameter which is equal to or less than ⅕ the average particle diameter of the toner. If the protruding portions are significantly great in size with respect to the toner, the toner with the protruding portions is inferior to spherical toners in uniformity of image quality.

A method for producing the toner particles of the present invention can be suitably selected from polymerization methods. Since the toner particles are mainly formed of polyester, and substantially hemispherical shapes can be easily obtained, it is desirable to employ a method in which an oil droplet of an organic solvent dissolving a toner composition including a prepolymer is dispersed into an aqueous medium, and the oil droplet is subjected to one of elongation reaction and crosslinking reaction. In this method, a polyester component that is a main component of a toner is dissolved in the organic solvent, a liquid droplet is formed by dispersing this solution into the aqueous medium, and toner particles are made from the liquid droplet.

It is possible to deposit fine resin particles on a surface of the oil droplet in the form of protrusions, by adding into the aqueous medium a fine resin particle component which is different in composition from polyester. If fine polyester particles are used for such fine resin particles in the aqueous medium, the polyester component in the liquid droplet and the fine particles are completely combined together, and thus it becomes difficult to create protrusions. Accordingly, in the present invention, it is possible to form protruding portions on the toner surface by making the protruding portions different in composition or compatibility from polyester.

Also in the present invention, the toner is obtained through external addition of a hard fine powder. For the hard fine powder in the present invention, an external additive conventionally used for the purpose of giving fluidity or charging properties to the toner can be used. For example, besides fine oxide particles, it is possible to use fine inorganic particles and fine hydrophobized inorganic particles, and it is desirable that the hard fine powder include at least one type of fine hydrophobized inorganic particles whose average primary particle diameter is 1 nm to 100 nm, preferably 5 nm to 70 nm.

It is more desirable that the hard fine powder include at least one type of small-diameter fine hydrophobized inorganic particles whose average primary particle diameter is 20 nm or less and also include at least one type of large-diameter fine hydrophobized inorganic particles whose average primary particle diameter is 30 nm or greater.

Also, it is desirable that the fine inorganic particles have a specific surface area of 20 $m^2/g$ to 500 $m^2/g$ based upon the BET method. The volume resistivity Rl of the large-diameter fine particles that are one of the two types of fine particles at least included in the hard fine powder is greater than the volume resistivity Rs of the small-diameter fine particles that are the other, with Rl being preferably in the range of 10 to 17 (Log Ωcm).

Rs is not particularly limited as long as it is smaller than Rl; however, it is desirable that Rs be in the range of 7 to 14 (Log Ωcm) so as not to hinder the generation of charge.

Any conventional external additive can be used as long as it satisfies the above-mentioned conditions. For example, fine silica particles, hydrophobic silica, fatty acid metal salts (zinc stearate, aluminum stearate, etc.), metal oxides (titania, alumina, tin oxide, antimony oxide, etc.), fluoropolymer and the like may be used.

As particularly suitable external additives, fine hydrophobized silica particles, fine hydrophobized titania particles, fine hydrophobized titanium oxide particles and fine hydrophobized alumina particles can be mentioned. Examples of the fine silica particles include HDKH 2000, HDK H 2000/4, HDK H 2050EP, HVK21 and HDK H 1303 (produced by Hoechst AG); and R972, R974, RX200, RY200, R202, R805 and R812 (produced by Nippon Aerosil Co., Ltd.). Examples of the fine titania particles include P-25 (produced by Nippon Aerosil Co., Ltd.); STT-30 and STT-65C-S (produced by Titan Kogyo Co., Ltd.); TAF-140 (produced by Fuji Titanium Industry Co., Ltd.); and MT-150W, MT-500B, MT-600B and MT-150A (produced by Tayca Corporation). Examples of the fine hydrophobized titanium oxide particles include T-805 (produced by Nippon Aerosil Co., Ltd.); STT-30A and STT-65S-S (produced by Titan Kogyo Co., Ltd.); TAF-500T and TAF-1500T (produced by Fuji Titanium Industry Co., Ltd.); MT-100S and MT-100T (produced by Tayca Corporation); and IT-S (produced by Ishihara Sangyo Kaisha, Ltd.).

Fine hydrophobized oxide particles, fine hydrophobized silica particles, fine hydrophobized titania particles and fine hydrophobized alumina particles can be obtained by treating fine hydrophilic oxide particles, fine hydrophilic silica particles, fine hydrophilic titania particles and fine hydrophilic alumina particles with a silane coupling agent such as methyltrimethoxysilane, methyltriethoxysilane or octyltrimethoxysilane. Also, silicone oil-treated fine oxide particles and silicone oil-treated fine inorganic particles produced by treating fine inorganic particles with a silicone oil, in a heated state if necessary, can be suitably used.

Applicable examples of the silicone oil include dimethyl silicone oil, methylphenyl silicone oil, chlorphenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic-modified silicone oil, methacryl-modified silicone oil and α-methylstyrene-modified silicone oil.

Examples of the fine inorganic particles include silica, alumina, titanium oxide, barium titanate, magnesium titanate, calcium titanate, strontium titanate, iron oxide, copper oxide, zinc oxide, tin oxide, silica sand, clay, mica, tabular spar, diatomite, chromium oxide, cerium oxide, colcothar, antimony trioxide, magnesium oxide, zirconium oxide, barium sulfate, barium carbonate, calcium carbonate, silicon carbide and silicon nitride. Amongst these, silica and titanium dioxide are particularly preferable.

The added amount of the fine inorganic particles can be 0.1% by mass to 5% by mass, preferably 0.3% by mass to 3% by mass, to the toner.

The average primary particle diameter of the fine inorganic particles is 100 nm or less, preferably in the range of 3 nm to 70 nm. If it is less than 3 nm, the fine inorganic particles are embedded in the toner, and thus the toner is prevented from effectively performing its functions. If it is greater than 70 nm, a photoconductor surface is unevenly scratched, which is unfavorable.

Additionally, the hard fine powder can be selected from fine polymeric particles exemplified by those of polystyrene, methacrylic acid ester copolymer, acrylic acid ester copolymer and silicone obtained by means of soap-free emulsion polymerization, suspension polymerization or dispersion polymerization; those of polycondensed compounds such as benzoguanamine and nylon; and those of thermosetting resins.

When the fine polymeric particles are used as a fluidizer, the fluidizer is surface-treated so as to improve its hydrophobicity, and can therefore prevent reduction in fluidity and charging properties even at high temperatures. Suitable examples of surface-treating agents include silane coupling agents, silylation agents, silane coupling agents having fluorinated alkyl groups, organic titanate-based coupling agents, aluminum-based coupling agents, silicone oils and modified silicone oils.

Also, a cleaning ability enhancer for removing a developer which remains on a photoconductor and on a primary transfer medium after transfer can be included in the fine resin particles. Examples thereof include fatty acid metal salts such as zinc stearate, calcium stearate and stearic acid; and fine polymer particles produced by means of soap-free emulsion polymerization or the like, such as fine polymethyl methacrylate particles and fine polystyrene particles. It is desirable that the fine polymer particles have a relatively narrow particle size distribution and that their volume average particle diameter be in the range of 0.01 μm to 1 μm.

For these fine powders, fine resin particles such as particles produced by means of emulsion polymerization can also be used. In the present invention, fine resin particles can also be added according to necessity.

Meanwhile, it is desirable that the fine resin particles used have a glass transition temperature (Tg) of 40° C. to 100° C. and a mass average molecular weight of 9,000 to 200,000. As described earlier, when the glass transition temperature (Tg) is lower than a minimum value of 40° C. or the mass average molecular weight is less than a minimum value of 9,000, the storage stability of the toner becomes poor, and blocking is caused at the time of storage and in a developing device. When the glass transition temperature (Tg) is higher than a maximum value of 100° C. or the mass average molecular weight is greater than a maximum value of 200,000, the fine resin particles hinder adhesion between the toner and paper that is a medium where images are fixed, and there is a rise in minimum fixing temperature.

It is further desirable that the residual ratio of the fine resin particles to the toner particles be in the range of 0.5% by mass to 5.0% by mass. When the residual ratio is less than 0.5% by mass, the storage stability of the toner becomes poor, and blocking is caused at the time of storage and in the developing device. When the residual ratio is greater than 5.0% by mass, the fine resin particles hinder wax from exuding and thus the wax is not effectively released, thereby causing offset.

The residual ratio of the fine resin particles to the toner particles can be measured by analyzing the fine resin particles with a pyrolysis gas chromatograph mass spectrometer and making a calculation based upon the peak area thereof. A mass spectrometer is preferable as a detector, but there is no limitation in particular.

The fine resin particles are not particularly limited as long as a resin capable of forming an aqueous dispersoid is used, and the resin may be selected from thermoplastic resins and thermosetting resins. Examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins.

Two or more of these resins may be used together to form the fine resin particles. Amongst these resins, vinyl resin, polyurethane resin, epoxy resin, polyester resin and combinations thereof are preferable in that an aqueous dispersoid formed of fine spherical resin particles can be easily obtained. The vinyl resin is a polymer formed by homopolymerizing or copolymerizing a vinyl monomer, and examples thereof include styrene-(meth)acrylic acid ester resins, styrene-butadiene copolymers, (meth)acrylic acid-acrylic acid ester polymers, styrene-acrylonitrile copolymers, styrene-maleic anhydride copolymers and styrene-(meth)acrylic acid copolymers.

It is important for the toner of the present invention to have a particular shape and distribution of shape, and it is desirable that the average sphericity E of the toner be in the range of 0.90 to 0.99. Toners that are 0.90 or less in average sphericity E and have indefinite shapes very different from spheres do not make it possible to obtain satisfactory transfer ability or high-quality images without dirt. Toners that are greater than 0.99 in average sphericity E are shaped like complete spheres and are not favorable because trouble with cleaning ability is caused.

As a method for measuring the shape of the toner, it is possible to employ a method in which a suspension including toner particles is passed through an imaged portion sensing zone over a flat plate, and a particle image is optically sensed with a CCD camera and thus analyzed. The average sphericity E is calculated by dividing the circumference of a corresponding circle having an projected area equal to that of the toner, obtained according to this method, by the circumference of actual particles.

In order for the toner to form high-resolution images with an appropriate density and great reproducibility, it is further desirable that the average sphericity E be in the range of 0.94 to 0.99.

It is more desirable that the average sphericity E be in the range of 0.94 to 0.99 and that particles which are less than 0.94 in sphericity exist by 10% or less, in terms of facilitation of cleaning.

The average sphericity E can be measured by flow particle image analyzer FPIA-2100 (produced by TOA Medical Electronics Co., Ltd.).

As for a specific method for measuring the average sphericity E, 0.1 ml to 0.5 ml of a surfactant, preferably alkylbenzene sulfonate, is added as a dispersant into 100 ml to 150 ml of water from which impure solid matter in a container has previously been removed, and then approximately 0.1 g to 0.5 g of a measurement sample is added. The suspension in which the sample is dispersed is subjected to a dispersing process for about 1 min to 3 min using an ultrasonic dispersing apparatus, the shape and distribution of the toner are measured by the analyzer with the concentration of the dispersion solution being 3,000/μl to 10,000/μl, and the average sphericity E is thus calculated.

(Degree of Circularity SF-1 and SF-2)

As to shape factors SF-1 and SF-2 that are degrees of circularity employed in the present invention, 300 of toner SEM images obtained by electron scanning microscope FE-SEM (S-4200) produced by Hitachi, Ltd. are randomly sampled, information on the images is introduced into an image analyzer (Luzex AP) produced by Nireco Corporation via an interface and analyzed, and the values obtained by calculating the following equations are defined as SF-1 and SF-2. It is desirable that the values of SF-1 and SF-2 be calculated using Luzex AP; however, it is possible to use apparatuses other than the FE-SEM and the image analyzer, provided that similar results of analysis can be obtained.

$$SF\text{-}1=(L^2/A)\times(\pi/4)\times 100$$

$$SF\text{-}2=(P^2/A)\times(1/4\pi)\times 100$$

Here, L denotes the absolute maximum length of the toner, A denotes the projected area of the toner and P denotes the maximum circumference of the toner. When the toner is a complete sphere, both SF-1 and SF-2 stand at 100. As SF-1 and SF-2 become greater than 100, the shape of the toner shifts from a sphere to an indefinite shape. SF-1 is a shape factor representing the overall shape of the toner (an oval, sphere, etc.) in particular, and SF-2 is a shape factor representing the extent of unevenness of a surface in particular.

(Volume Average Particle Diameter and Dv/Dn (Ratio Between Volume Average Particle Diameter and Number Average Particle Diameter))

The toner of the present invention is a dry toner wherein the volume average particle diameter (Dv) is preferably in the range of 2 μm to 7 μm, and the ratio (Dv/Dn) between the volume average particle diameter (Dv) and the number average particle diameter (Dn) is 1.25 or less, preferably in the range of 1.10 to 1.25. Thus, the toner is superior in heat-resistance storage stability, low-temperature fixing properties and hot offset resistance, and superior in glossiness of images especially when used in a full-color copier or the like. Further, in a two-component developer, the toner particles do not significantly vary in diameter even when the cycle of consumption and addition of the toner has been repeated for a long time, and image-developing properties that are favorable and stable can be obtained even when the toner has been agitated for a long time in a developing device.

Also, in the case where the toner is used for a single-component developer, the toner particles do not significantly vary in diameter even when the cycle of consumption and addition of the toner has been repeated. In addition, the toner is prevented from forming as a film on a developing roller and fusing onto members such as a blade for making a thin layer of the toner, and image-developing properties and images that are favorable and stable can be obtained even when the toner has been used (agitated) for a long time in a developing device. Especially when fine inorganic particles which have been surface-treated by both a fluorine-containing compound and a silicon-containing compound are used as a fluidizer, there is less margin for filming because of a fluorine-containing group, so that the aforementioned particle size distribution is preferable.

It is generally known that the smaller a toner is in particle diameter, the more advantageous the toner is in obtaining high-resolution and high-quality images; conversely, the toner is disadvantageous in terms of transfer ability and cleaning ability. Also, in the case where a toner has a smaller volume average particle diameter than is prescribed in the present invention, in a two-component developer, the toner is liable to fuse onto a surface of a carrier when agitated for a long time in a developing device, thus lessening the charging ability of the carrier, and when the toner is used for a single-component developer, the toner is liable to form as a film on a developing roller and fuse onto members such as a blade for making a thin layer of the toner.

Similarly, these phenomena occur also in the case where a toner contains more fine powder than is prescribed in the present invention.

Conversely, in the case where a toner has a larger particle diameter than is prescribed in the present invention, there is a high possibility that it is difficult to obtain high-resolution and high-quality images, and that the toner varies significantly in particle diameter when the cycle of consumption and addition of the toner in a developer has been repeated. Similarly, these phenomena may occur also in the case where the volume average particle diameter/the number average particle diameter is greater than 1.25.

(Resin)

In the present invention, polyester resin can be used as a resin, and modified polyester resin can be used as the polyester resin. For instance, an isocyanate group-containing polyester prepolymer can be used. Examples of the isocyanate group-containing polyester prepolymer (A) include a polyester which is a polycondensate of a polyol (1) and a polycarboxylic acid (2), contains an active hydrogen group and has reacted with a polyisocyanate (3).

Examples of the active hydrogen group contained in the polyester include hydroxyl groups (alcoholic hydroxyl group and phenolic hydroxyl group), amino group, carboxyl group and mercapto group, with alcoholic hydroxyl group being preferable.

Examples of the polyol (1) include a diol (1-1) and a trivalent or higher polyol (1-2), with use of (1-1) alone or use of a mixture of (1-1) and a small amount of (1-2) being preferable.

Examples of the diol (1-1) include alkylene glycols (ethylene glycol, 1,2-propylene glycol, 1,3-propylene glycol, 1,4-butanediol, 1,6-hexanediol, etc.); alkylene ether glycols (diethylene glycol, triethylene glycol, dipropylene glycol, polyethylene glycol, polypropylene glycol, polytetramethylene ether glycol, etc.); alicyclic diols (1,4-cyclohexane dimethanol, hydrogenated bisphenol A, etc.); bisphenols (bisphenol A, bisphenol F, bisphenol S, etc.); alkylene oxide (ethylene oxide, propylene oxide, butylene oxide, etc.) adducts of the alicyclic diols; and alkylene oxide (ethylene oxide, propylene oxide, butylene oxide, etc.) adducts of the bisphenols. Amongst these, alkylene glycols having 2 to 12 carbon atoms, and alkylene oxide adducts of the bisphenols are preferable; and alkylene oxide adducts of the bisphenols, and combinations of alkylene oxide adducts of the bisphenols and alkylene glycols having 2 to 12 carbon atoms are particularly preferable.

Examples of the trivalent or higher polyol (1-2) include trivalent to octavalent or higher multivalent aliphatic alcohols (glycerin, trimethylolethane, trimethylolpropane, pentaerythritol, sorbitol, etc.); trivalent or higher phenols (trisphenol PA, phenol novolac, cresol novolac, etc.); and alkylene oxide adducts of the trivalent or higher phenols.

Examples of the polycarboxylic acid (2) include a dicarboxylic acid (2-1) and a trivalent or higher polycarboxylic acid (2-2), with use of (2-1) alone or use of a mixture of (2-1) and a small amount of (2-2) being preferable.

Examples of the dicarboxylic acid (2-1) include alkylene dicarboxylic acids (succinic acid, adipic acid, sebacic acid, etc.); alkenylene dicarboxylic acids (maleic acid, fumaric acid, etc.); and aromatic dicarboxylic acids (phthalic acid, isophthalic acid, terephthalic acid, naphthalenedicarboxylic acid, etc.). Amongst these, alkenylene dicarboxylic acids having 4 to 20 carbon atoms, and aromatic dicarboxylic acids having 8 to 20 carbon atoms are preferable.

Examples of the trivalent or higher polycarboxylic acid (2-2) include aromatic polycarboxylic acids having 9 to 20 carbon atoms (trimellitic acid, pyromellitic acid, etc.).

Additional examples of the polycarboxylic acid (2) include products prepared by means of reaction between acid anhydrides or lower alkyl esters (methyl ester, ethyl ester, isopropyl ester, etc.) of the above-mentioned compounds and the polyol (1).

The ratio of the polyol (1) to the polycarboxylic acid (2) is normally in the range of 2/1 to 1/1, preferably in the range of 1.5/1 to 1/1, more preferably in the range of 1.3/1 to 1.02/1, as the equivalent ratio of hydroxyl groups [OH] to carboxyl groups [COOH], i.e. [OH]/[COOH].

Examples of the polyisocyanate (3) include aliphatic polyisocyanates (tetramethylene diisocyanate, hexamethylene diisocyanate, 2,6-diisocyanatomethyl caproate, etc.); alicyclic polyisocyanates (isophorone diisocyanate, cyclohexylmethane diisocyanate, etc.); aromatic diisocyanates (tolylene diisocyanate, diphenylmethane diisocyanate, etc.); aromatic-aliphatic diisocyanates ($\alpha,\alpha,\alpha',\alpha'$-tetramethylxylylene diisocyanate, etc.); isocyanurates; compounds obtained by blocking the polyisocyanates with a phenol derivative, oxime, caprolactam, etc.; and combinations of two or more thereof.

As to the constitution of the polyisocyanate (3), the equivalent ratio of isocyanate groups [NCO] to hydroxyl groups [OH] of the polyester, i.e. [NCO]/[OH], is normally in the range of 5/1 to 1/1, preferably in the range of 4/1 to 1.2/1, more preferably in the range of 2.5/1 to 1.5/1. When [NCO]/[OH] is greater than 5, there is a reduction in low-temperature fixing properties. When the molar ratio of [NCO] is less than 1, the amount of urea contained in the modified polyester is small, so that there is a reduction in hot offset resistance. The amount of components of the polyisocyanate (3) contained in the prepolymer (A) having isocyanate groups at its terminals is normally 0.5% by mass to 40% by mass, preferably 1% by mass to 30% by mass, more preferably 2% by mass to 20% by mass. When it is less than 0.5% by mass, there is a reduction in hot offset resistance, and also there is a disadvantage in terms of achievement of both heat-resistance storage stability and low-temperature fixing properties. When it is greater than 40% by mass, there is a reduction in low-temperature fixing properties.

The number of isocyanate groups contained in the isocyanate group-containing prepolymer (A) per molecule is normally 1 or more, preferably 1.5 to 3 on average, more preferably 1.8 to 2.5 on average. When it is less than 1 per molecule, the molecular weight of the modified polyester decreases after crosslinkage and/or elongation, so that there is a reduction in hot offset resistance.

(Crosslinking Agent and Elongation Agent)

In the present invention, amines can be used as a crosslinking agent and/or an elongation agent. Examples of the amines (B) include diamines (B1), trivalent or higher polyamines (B2), amino alcohols (B3), amino mercaptans (B4), amino acids (B5) and compounds (B6) obtained by blocking amino groups of any one of (B1) to (B5).

Examples of the diamines (B1) include aromatic diamines (phenylenediamine, diethyltoluenediamine, 4,4'-diaminodiphenylmethane, etc.); alicyclic diamines (4,4'-diamino-3,3'-dimethyldicyclohexylmethane, diamine cyclohexane, isophoronediamine, etc.); and aliphatic diamines (ethylenediamine, tetramethylene diamine, hexamethylenediamine, etc.).

Examples of the trivalent or higher polyamines (B2) include diethylenetriamine and triethylenetetramine.

Examples of the amino alcohols (B3) include ethanolamine and hydroxyethylaniline.

Examples of the amino mercaptans (B4) include aminoethyl mercaptan and aminopropyl mercaptan.

Examples of the amino acids (B5) include aminopropionic acid and aminocaproic acid.

Examples of the compounds (B6) obtained by blocking amino groups of any one of (B1) to (B5) include ketimine compounds and oxazoline compounds derived from the amines of (B1) to (B5) and ketones (acetone, methyl ethyl ketone, methyl isobutyl ketone, etc.). Amongst the amines (B), (B1) and a mixture of (B1) and a small amount of (B2) are preferable.

Further, as to crosslinkage and/or elongation, the molecular weight of the modified polyester after the crosslinkage and/or the elongation can be adjusted using a terminator according to necessity. Examples of the terminator include monoamines (diethylamine, dibutylamine, butylamine, laurylamine, etc.) and compounds (ketimine compounds) obtained by blocking these monoamines.

As to the constitution of the amines (B), the equivalent ratio of isocyanate groups [NCO] in the prepolymer (A) to amino groups [NHx] in the amines (B), i.e. [NCO]/[NHx], is normally in the range of 1/2 to 2/1, preferably in the range of 1.5/1 to 1/1.5, more preferably in the range of 1.2/1 to 1/1.2. When [NCO]/[NHx] is greater than 2 or less than 1/2, the molecular weight of a urea-modified polyester (i) decreases, so that there is a reduction in hot offset resistance.

For the polyester resin in the present invention, it is important that not only is the modified polyester (A) used but also an unmodified polyester (C) is used as a toner binder component together with (A). The additional use of (C) makes it possible to improve low-temperature fixing properties, and glossiness when the polyester resin is used in a full-color apparatus.

Examples of (C) include a polycondensate of a polyol (1) and a polycarboxylic acid (2) that are similar to polyester components of (A), and compounds suitable for (C) are also similar to those suitable for (A). Not limited to an unmodified polyester, (C) may be selected from compounds modified with chemical bonds other than urea bonds, for example compounds modified with urethane bonds.

It is desirable that (A) and (C) be compatible with each other at least partially, in terms of low-temperature fixing properties and hot offset resistance. Accordingly, it is desirable that the polyester component of (A) and the polyester component of (C) have similar compositions. When (A) is added, the weight ratio of (A) to (C) is normally in the range of 5/95 to 75/25, preferably in the range of 10/90 to 25/75, more preferably 12/88 to 25/75, even more preferably in the range of 12/88 to 22/78. When the weight ratio of (A) is less than 5%, there is a reduction in hot offset resistance, and also there is a disadvantage in terms of achievement of both heat-resistance storage stability and low-temperature fixing properties.

The peak molecular weight of (C) is normally 1,000 to 30,000, preferably 1,500 to 10,000, more preferably 2,000 to 8,000. When it is less than 1,000, there is a reduction in heat-resistance storage stability, and when it is greater than 10,000, there is a reduction in low-temperature fixing properties.

The hydroxyl value of (C) is preferably 5 or more, more preferably in the range of 10 to 120, even more preferably in the range of 20 to 80. When it is less than 5, there is a disadvantage in terms of achievement of both heat-resistance storage stability and low-temperature fixing properties.

The acid value of (C) is normally in the range of 0.5 to 40, preferably in the range of 5 to 35. When (C) has an acid value, (C) tends to be negatively charged. When the acid value and hydroxyl value of a polyester are beyond these ranges, the polyester is liable to be affected by its environment at high temperatures and high humidity and at low temperatures and low humidity, thereby possibly leading to a reduction in image quality.

In the present invention, the glass transition temperature (Tg) of the toner is normally 40° C. to 70° C., preferably 45° C. to 55° C. When it is lower than 40° C., the heat-resistance storage stability of the toner becomes poor, and when it is higher than 70° C., the toner's low-temperature fixing properties become insufficient.

Due to the fact that the crosslinked and/or elongated polyester resin is also used, the present invention's toner for developing latent electrostatic images exhibits better storage stability than a conventional polyester-based toner does, even when its glass transition temperature is low.

As for the storage elastic modulus of the toner, the temperature (TG') at which the storage elastic modulus becomes 10,000 dyne/cm$^2$ at a measurement frequency of 20 Hz is normally 100° C. or higher, preferably in the range of 110° C. to 2000. When the temperature (TG') is lower than 100° C., there is a reduction in hot offset resistance.

As for the viscosity of the toner, the temperature (Tη) at which the viscosity becomes 1,000 p at a measurement frequency of 20 Hz is normally 180° C. or lower, preferably in the range of 90° C. to 160°. When the temperature (Tη) is higher than 180° C., there is a reduction in low-temperature fixing properties. Accordingly, it is desirable that TG' be higher than Tη in view of achievement of both low-temperature fixing properties and hot offset resistance. In other words, the difference (TG'−Tη) between TG' and Tη is preferably 0° C. (0[deg.]) or greater, more preferably 10[deg.] or greater, even more preferably 20[deg.] or greater. The maximum value for the difference is not particularly limited. Also, it is desirable that the difference between Tη and Tg be 0[deg.] to 100[deg.], more desirably 10[deg.] to 90[deg.], even more desirably 20[deg.] to 80[deg.], in view of achievement of both heat-resistance storage stability and low-temperature fixing properties.

(Colorant)

The colorant of the present invention can be selected from all conventional dyes and pigments. Examples of the colorant include carbon black, nigrosine dyes, iron black, Naphthol Yellow S, Hanza Yellow (10G, 5G and G), Cadmium Yellow, yellow iron oxide, yellow ocher, chrome yellow, Titanium Yellow, Polyazo Yellow, Oil Yellow, Hanza Yellow (GR, A, RN and R), Pigment Yellow L, Benzidine Yellow (G and GR), Permanent Yellow (NCG), Balkan Fast Yellow (5G and R), Tartrazine Lake, Quinoline Yellow Lake, Anthrazane Yellow BGL, Isoindolinone Yellow, colcothar, red lead, Lead Vermillion, Cadmium Red, Cadmium Mercury Red, Antimony Vermillion, Permanent Red 4R, Para Red, Faicer Red, Parachlororthonitroaniline Red, Lithol Fast Scarlet G, Brilliant Fast Scarlet, Brilliant Carmine BS, Permanent Red (F2R, F4R, FRL, FRLL and F4RH), Fast Scarlet VD, Balkan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Hello Bordeaux BL, Bordeaux 10B, Bon Maroon Light, Bon Maroon Medium, Eosin Lake, Rhodamine Lake B, Rhodamine Lake Y, Alizarin Lake, Thioindigo Red B, Thioindigo Maroon, Oil Red, Quinacridone Red, Pyrazolone Red, Polyazo Red, Chrome Vermilion, Benzidine Orange, Perinone Orange, Oil Orange, Cobalt Blue, Cerulean Blue, Alkali Blue Lake, Peacock Blue Lake, Victoria blue lake, Non-metallic Phthalocyanine Blue, Phthalocyanine Blue, Fast Sky Blue, Indanthrene Blue (RS and BC), indigo, ultramarine blue, Prussian blue, Anthraquinone Blue, Fast Violet B, Methyl Violet Lake, Cobalt Violet, Manganese Violet, Dioxane Violet, Anthraquinone Violet, Chrome Green, Zinc Green, chromium oxide, pyridian, emerald green, Pigment Green B, Naphthol Green B, Green Gold, Acid Green Lake, Malachite Green Lake, Phthalocyanine Green, Anthraquinone Green, titanium oxide, Zinc Flower, lithopone, and mixtures thereof.

The amount of the colorant contained in the toner is normally in the range of 1% by mass to 15% by mass, preferably in the range of 3% by mass to 10% by mass.

The colorant in the present invention can be combined with a resin and thus used as a masterbatch.

Examples of the masterbatch or a binder resin kneaded with the masterbatch include the aforementioned modified/unmodified polyester resins; polymers of styrene and substitution products thereof, such as polystyrene, poly-p-chlorostyrene and polyvinyl toluene; styrene copolymers such as styrene-p-chlorostyrene copolymer, styrene-propylene copolymer, styrene-vinyl toluene copolymer, styrene-vinyl naphthaline copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chlormethacrylate copolymer, styrene-acrylonitril copolymer, styrene-vinyl methyl ketone copolymer, styrene-butadiene copolymer, styrene-isoprene copolymer, styrene-acrylonitrile-indene copolymer, styrene-maleic acid copolymer and styrene-maleic acid ester copolymer; polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic/alicyclic hydrocarbon resin, aromatic petroleum resin, chlorinated paraffin and paraffin wax. These can be used independently or in combination.

The masterbatch can be obtained by mixing or kneading a resin and a colorant for a masterbatch, with great shearing force applied. On this occasion, an organic solvent may be used so as to enhance interaction between the colorant and the resin.

Also, the so-called flashing method is suitable for production of the masterbatch, in which an aqueous paste of a colorant is mixed or kneaded with a resin and an organic solvent, the colorant is transferred to the resin side, and then a water content and the organic solvent are removed. This is because a wet cake of the colorant can be used as it is, and thus drying is not necessary. For the mixing or kneading, a high shear force dispersing apparatus such as a three-roller mill can be suitably used.

(Releasing Agent)

A wax can be contained in the toner, together with the toner binder and the colorant. The wax of the present invention can be selected from conventional waxes, and examples thereof include polyolefin waxes (polyethylene wax, polypropylene wax, etc.); long-chain hydrocarbons (paraffin wax, Sasol Wax, etc.); and carbonyl-containing waxes. Amongst these, carbonyl-containing waxes are preferable.

Examples of the carbonyl-containing waxes include polyalkanoic acid esters (carnauba wax, montan wax, trimethylolpropane tribehenate, pentaerythritol tetrabehenate, pentaerythritol diacetate dibehenate, glycerin tribehenate, 1,18-octadecanediol distearate, etc.); polyalkanol esters (tristearyl trimellitate, distearyl maleate, etc.); polyalkanoic acid amides (ethylenediamine dibehenylamide, etc.); polyalkylamides (tristearylamide trimellitate, etc.); and dialkyl ketones (distearyl ketone, etc.). Amongst these carbonyl-containing waxes, polyalkanoic acid esters are preferable.

The melting point of the wax in the present invention is normally 40° C. to 160° C., preferably 50° C. to 120° C., more preferably 60° C. to 90° C.

A wax whose melting point is lower than 40° C. has an adverse effect on heat-resistance storage stability, and a wax whose melting point is higher than 160° C. is liable to cause cold offset when an image is fixed at a low temperature.

The melt viscosity of the wax is preferably 5 cps to 100 cps, more preferably 10 cps to 100 cps, when measured at a temperature which is 20° C. higher than its melting point. A wax whose melt viscosity is greater than 1,000 cps does not effectively improve the toner's hot offset resistance and low-temperature fixing properties.

The amount of the wax contained in the toner is normally 0% by mass to 40% by mass, preferably 3% by mass to 30% by mass.

(Charge Control Agent)

A charge control agent may be contained in the toner so as to control the charge amount of the toner.

A method for allowing a charge control component to be borne on the toner can be selected from a method in which a compound such as a charge control agent is physically attached onto surfaces of base particles of a toner by agitating and mixing a base toner and the compound; a method in which the compound is fixed onto a toner surface by utilizing heat, mechanical impact or the like; a method in which a functional group on a toner surface and a charge controlling compound are bonded to each other by means of a chemical reaction; and the like.

The charge control agent herein stated can be selected from all conventional charge control agents. Examples thereof include nigrosine dyes, triphenylmethane dyes, chromium-containing metal complex dyes, molybdic acid chelate pigments, rhodamine dyes, alkoxyamines, quaternary ammonium salts (including fluorine-modified quaternary ammonium salts), alkylamides, elementary substance or compounds of phosphorus, elementary substance or compounds of tungsten, fluorine-containing active agents, metal salts of salicylic acid and metal salts of salicylic acid derivatives.

Specific examples thereof include BONTRON 03 as a nigrosine dye, BONTRON P-51 as a quaternary ammonium salt, BONTRON S-34 as a metal-containing azo dye, BONTRON E-82 as an oxynaphthoic acid metal complex, BONTRON E-84 as a salicylic acid metal complex and BONTRON E-89 as a phenolic condensate (produced by Orient Chemical Industries, Ltd.); TP-302 and TP-415 as quaternary ammonium salt molybdenum complexes (produced by Hodogaya Chemical Co., Ltd.); COPY CHARGE PSY VP2038 as a quaternary ammonium salt, COPY BLUE PR as a triphenylmethane derivative, and COPY CHARGE NEG VP2036 and COPY CHARGE NX VP434 as quaternary ammonium salts (produced by Hoechst AG); LRA-901, and LR-147 as a boron complex (produced by Japan Carlit Co., Ltd.); copper phthalocyanine, perylene, quinacridone and azo pigments; and polymeric compounds having functional groups such as sulfonic group, carboxyl group and quaternary ammonium salt.

(Production of Toner)

The toner of the present invention can be produced by the following method.

First, for the toner binder, a hydroxyl group-containing polyester is obtained by heating the polyol (1) and the polycarboxylic acid (2) to a temperature of 150° C. to 280° C. in the presence of a conventional esterification catalyst such as tetrabutoxy titanate or dibutyltin oxide and removing produced water by means of distillation under reduced pressure if necessary. Subsequently, this polyester is made to react with the polyisocyanate (3) at 40° C. to 140° C. so as to yield an isocyanate group-containing prepolymer (A).

The toner of the present invention can be produced in an aqueous medium.

As to an aqueous phase used in the present invention, fine resin particles are previously added into the aqueous phase. The aqueous phase may be formed solely of water or formed of water and a solvent miscible with water.

Examples of the solvent miscible with water include alcohols (methanol, isopropanol, ethylene glycol, etc.), dimethylformamide, tetrahydrofuran, cellosolves (methyl cellosolve, etc.) and lower ketones (acetone, methyl ethyl ketone, etc.).

Toner particles can be obtained by means of a reaction between a dispersoid composed of the isocyanate group-containing polyester prepolymer (A) dissolved or dispersed in an organic solvent in the aqueous phase and the amines (B).

As a method for stably forming the dispersoid composed of the polyester prepolymer (A) in the aqueous phase, there is, for example, a method in which a composition of a toner raw material composed of the polyester prepolymer (A) dissolved or dispersed in the organic solvent is added into the aqueous phase, and the composition is dispersed by means of shearing force.

The polyester prepolymer (A) dissolved or dispersed in the organic solvent and other toner compositions (hereinafter referred to as "toner materials"), i.e. the colorant, the colorant masterbatch, the releasing agent, the charge control agent, the unmodified polyester resin, etc. may be mixed when the dispersoid is formed in the aqueous phase; however, it is desirable to previously mix the toner materials with the polyester prepolymer (A), then dissolve or disperse the mixture in the organic solvent, and subsequently add and disperse the mixture into the aqueous phase.

Also in the present invention, it is not that the toner materials except the resin, such as the colorant, the releasing agent and the charge control agent, necessarily have to be mixed with the polyester prepolymer (A) when particles are formed in the aqueous phase, but that they may be added after the particles have been formed. For example, it is possible to add the colorant by a conventional dyeing process, after particles not including the colorant have been formed. Although not particularly limited, the dispersing process is suitably exemplified by conventional processes such as a low-speed shear dispersion process, a high-speed shear dispersion process, a dispersing process by friction, a high-pressure jet dispersion process and an ultrasonic dispersion process.

To allow the dispersoid to be 2 μm to 20 μm in particle diameter, preference is given to a high-speed shear dispersion process. When a high-speed shear dispersion apparatus is used, the number of rotations of the apparatus is not particularly limited, but it is normally 1,000 rpm to 30,000 rpm, preferably 5,000 rpm to 20,000 rpm. The length of time spent on the dispersion is not particularly limited, but it is normally 0.1 min to 5 min in the case of a batch system. The temperature at the time of dispersion is normally 0° C. to 150° C. (under pressure), preferably 40° C. to 98° C. It is desirable that the temperature be high because the dispersoid composed of the polyester prepolymer (A) becomes low in viscosity and thus dispersion can be facilitated.

The amount by which the aqueous phase is used for 100 parts by mass of a toner composition containing the polyester prepolymer (A) is normally 50 parts by mass to 2,000 parts by mass, preferably 100 parts by mass to 1,000 parts by mass. When it is less than 50 parts by mass, the toner composition is poorly dispersed, and thus toner particles of the predetermined diameter cannot be obtained. It is not desirable for it to exceed 2,000 parts by mass for economical reasons. Additionally, a dispersant may be used according to necessity. Use of a dispersant is favorable in that the particle size distribution becomes sharp and also the dispersion becomes stable.

Examples of the dispersant for emulsifying and dispersing an oil phase, where a toner composition is dispersed, into an aqueous phase include anionic surfactants such as alkylbenzene sulfonates, α-olefin sulfonates and phosphoric esters; amine salt surfactants such as alkylamine salts, amino alcohol fatty acid derivatives, polyamine fatty acid derivatives and imidazoline; quaternary ammonium salt cationic surfactants such as alkyltrimethylammonium salts, dialkyldimethylammonium salts, alkyldimethylbenzylammonium salts, pyridinium salts, alkylisoquinolinium salts and benzethonium chloride; nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N, N-dimethylammonium betaines.

Also, the effect of the dispersant can be produced with only a very small amount thereof, by using a fluoroalkyl-containing surfactant.

Suitable examples of fluoroalkyl-containing anionic surfactants include fluoroalkylcarboxylic acids having 2 to 10 carbon atoms and metal salts thereof, disodium perfluorooctanesulfonyl glutamate, sodium 3-[omega-fluoroalkyl($C_6$-$C_{11}$)oxy]-1-alkyl($C_3$-$C_4$) sulfonate, sodium 3-[omega-fluoroalkanoyl($C_6$-$C_8$)—N-ethylamino]-1-propanesulfonate, fluoroalkyl($C_{11}$-$C_{20}$) carboxylic acids and metal salts thereof, perfluoroalkylcarboxylic acids($C_7$-$C_{13}$) and metal salts thereof, perfluoroalkyl($C_4$-$C_{12}$) sulfonic acids and metal salts thereof, perfluorooctanesulfonic acid diethanolamide, N-propyl-N-(2-hydroxyethyl)perfluorooctanesulfonamide, perfluoroalkyl($C_6$-$C_{10}$) sulfonamide propyltrimethyl ammonium salts, perfluoroalkyl($C_6$-$C_{10}$)—N-ethylsulfonyl glycine salts, and monoperfluoroalkyl($C_6$-$C_{16}$) ethyl phosphoric acid esters.

Such fluoroalkyl-containing anionic surfactants are commercially available, for example under the trade names of SURFLON S-111, S-112 and S-113 (produced by Asahi Glass Co., Ltd.), FLUORAD FC-93, FC-95, FC-98 and FC-129 (produced by Sumitomo 3M Limited), UNIDYNE DS-101 and DS-102 (produced by Daikin Industries, Ltd.), MEGAFAC F-110, F-120, F-113, F-191, F-812 and F-833 (produced by Dainippon Ink And Chemicals, Incorporated), EFTOP EF-102, EF-103, EF-104, EF-105, EF-112, EF-123A, EF-123B, EF-306A, EF-501, EF-201 and EF-204 (produced by Tohkem Products Corporation) and FTERGENT F-100 and F-150 (produced by Neos Company Limited).

Examples of fluoroalkyl-containing cationic surfactants include aliphatic primary, secondary and tertiary amine acids each having a fluoroalkyl group; aliphatic quaternary ammonium salts such as perfluoroalkyl($C_6$-$C_{10}$) sulfonamide propyltrimethyl ammonium salts; benzalkonium salts; benzethonium chloride; pyridinium salts; and imidazolinium salts. Such fluoroalkyl-containing cationic surfactants are commercially available, for example under the trade names of SURFLON S-121 (produced by Asahi Glass Co., Ltd.), FLUORAD FC-135 (produced by Sumitomo 3M Limited), UNIDYNE DS-202 (produced by Daikin Industries, Ltd.), MEGAFAC F-150 and F-824 (produced by Dainippon Ink And Chemicals, Incorporated), EFTOP EF-132 (produced by Tohkem Products Corporation) and FTERGENT F-300 (produced by Neos Company Limited).

In addition, an inorganic compound which is sparingly soluble in water, such as tricalcium phosphate, calcium carbonate, titanium oxide, colloidal silica or hydroxyapatite can also be used as the dispersant.

Dispersed droplets may be stabilized by a polymeric protective colloid.

Examples of the polymeric protective colloid include homopolymers and copolymers of acids such acrylic acid, methacrylic acid, α-cyanoacrylic acid, α-cyanomethacrylic acid, itaconic acid, crotonic acid, fumaric acid, maleic acid and maleic anhydride; homopolymers and copolymers of hydroxyl-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerin monoacrylic ester, glycerin monomethacrylic ester, N-methylolacrylamide and N-methylolmethacrylamide; homopolymers and copolymers of vinyl alcohol and ethers of vinyl alcohol such as vinyl methyl ether, vinyl ethyl ether and vinyl propyl ether; homopolymers and copolymers of esters of vinyl alcohol and carboxyl-containing compounds, such as vinyl acetate, vinyl propionate and vinyl butyrate; homopolymers and copolymers of acrylamide, methacrylamide, diacetone acrylamide, and methylol compounds thereof; homopolymers and copolymers of acid chlorides such as acryloyl chloride and methacryloyl chloride; homopolymers and copolymers of compounds containing nitrogen atoms or containing heterocycles having nitrogen atoms, such as vinylpyridine, vinylpyrrolidone, vinylimidazole and ethyleneimine; polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester and polyoxyethylene nonyl phenyl ester; and cellulose and derivatives thereof such as methyl cellulose, hydroxyethyl cellulose and hydroxypropyl cellulose.

In the case where a dispersion stabilizer, such as calcium phosphate, that is soluble in acids or bases is used, the dispersion stabilizer is, for example, dissolved in an acid such as hydrochloric acid, and then the dispersion stabilizer is removed from fine particles by means of washing or the like. Alternatively, the dispersion stabilizer can be removed by means of decomposition produced by an enzyme, for example.

In the case where a dispersant is used, although the dispersant can be left on surfaces of toner particles, it is desirable in terms of the toner's charging capability that the dispersant be washed away after at least one of elongation reaction and crosslinking reaction is over.

The length of time spent on the elongation reaction and/or the crosslinking reaction is selected depending upon the reactivity derived from the combination of the isocyanate structure of the prepolymer (A) and the amine (B), but it is normally 10 min to 40 hr, preferably 2 hr to 24 hr.

The reaction temperature is normally 0° C. to 150° C., preferably 40° C. to 98° C. Additionally, it is possible to use a conventional catalyst according to necessity. Specific examples of the catalyst include dibutyltin laurate and dioctyltin laurate.

The organic solvent can be removed from the prepared emulsion, for example by gradually increasing the temperate of the entire system and completely removing the organic solvent in liquid droplets by evaporation. Alternatively, it is possible to spray the emulsion into a dry atmosphere, completely remove the water-insoluble organic solvent in liquid droplets and thusly form fine toner particles, and while doing so, it is possible to remove the aqueous dispersant by evaporation.

(Carrier for Two-Component Developer)

When the toner of the present invention is used for a two-component developer, it is appropriate that the toner be mixed with a magnetic carrier, and the content ratio of the magnetic carrier to the toner in the developer is preferably in the range of 100 parts by mass to 1 part by mass to 100 parts by mass to 10 parts by mass.

The magnetic carrier can be selected from conventional magnetic carriers exemplified by iron powder, ferrite powder, magnetite powder and magnetic resin, all of which are 20 μm to 200 μm in particle diameter.

Examples of coating materials include amino resins such as urea-formaldehyde resins, melamine resins, benzoguanamine resins, urea resins, polyamide resins and epoxy resins; polyvinyl resins and polyvinylidene resins such as acrylic resins, polymethyl methacrylate resins, polyacrylonitrile resins, polyvinyl acetate resins, polyvinyl alcohol resins and polyvinyl butyral resins; polystyrene-based resins such as polystyrene resins and styrene-acrylic copolymer resins; halogenated olefin resins such as polyvinyl chloride; polyester resins such as polyethylene terephthalate resins and polybutylene terephthalate resins; polycarbonate resins; polyethylene resins; polyvinyl fluoride resins; polyvinylidene fluoride resins; polytrifluoroethylene resins; polyhexafluoropropylene resins; copolymers of vinylidene fluoride and acrylic monomers; vinylidene fluoride-vinyl fluoride copolymers; fluoroterpolymers such as terpolymers of tetrafluoroethylene, vinylidene fluoride and non-fluorinated monomers; and silicone resins.

Conductive powders or the like may be contained in those coating materials according to necessity. Examples of the conductive powders include metal powders, carbon black, titanium oxide, tin oxide and zinc oxide. Amongst these conductive powders, ones which are 1 μm or less in average particle diameter are preferable. When the conductive powders are greater than 1 μm in average particle diameter, it is difficult to control electric resistance.

Also, the toner of the present invention can be used as a carrier-free single-component magnetic toner or nonmagnetic toner.

(Intermediate Transfer Member)

The toner of the present invention can be suitably used in an image forming apparatus having an intermediate transfer member. The following explains one embodiment of the intermediate transfer member.

FIG. 1 is a schematic structural diagram of a copier according to the present embodiment. A charging roller 20 serving as a charger, an exposer 30, a cleaner 60 having a cleaning blade, a charge-eliminating lamp 70 serving as a charge eliminator, a developing device 40 and an intermediate transfer member 50 are provided in the vicinity of a photoconductor drum (hereinafter referred to as "photoconductor") 10 serving as an image-bearing member.

The intermediate transfer member 50 is supported by a plurality of supporting rollers 51 and made to run endlessly in the arrow direction by a drive unit such as a motor (not depicted). A part of these supporting rollers 51 serves also as a transfer bias roller which supplies a transfer bias to the intermediate transfer member, and a predetermined transfer bias voltage is applied thereto from a power source (not depicted).

Also, a cleaner 90 having a cleaning blade for cleaning the intermediate transfer member 50 is provided as well.

A transfer roller 80, which is a transfer unit for transferring a developed image onto a transfer paper 100 serving as a final transfer material, is provided facing the intermediate transfer member 50, and the transfer roller 80 is supplied with a transfer bias by a power supply unit (not depicted). Also, a corona charger 52 serving as a unit for giving charge is provided in the vicinity of the intermediate transfer member 50.

The developing device 40 is composed of a developing belt 41 serving as a developer bearing member; and a black (hereinafter abbreviated as "Bk") developing unit 45K, a yellow (hereinafter abbreviated as "Y") developing unit 45Y, a magenta (hereinafter abbreviated as "M") developing unit 45M and a cyan (hereinafter abbreviated as "C") developing unit 45C, disposed in the vicinity of the developing belt 41.

Set on a plurality of belt rollers, the developing belt 41 is made to run endlessly in the arrow direction by a drive unit such as a motor (not depicted), and moves at approximately the same velocity as the photoconductor 10 at a portion where it is in contact with the photoconductor 10. Since all the developing units are identically configured, only the Bk developing unit 45K will be explained below to avoid redundancy, and explanations of the developing units 45Y, 45M and 45C will be omitted. Note that in the drawings, components of the developing units 45Y, 45M and 45C corresponding to the ones of the Bk developing unit 45K will be given the symbols "Y", "M" and "C" as well as their respective numbers.

The developing unit 45K is composed of a developing tank 42K configured to contain a highly-viscous, highly-concentrated liquid developer including toner particles and a carrier liquid component, a scooping roller 43K placed such that its lower portion is immersed in the liquid developer in the developing tank 42K, and an applying roller 44K which makes a thin layer of the developer scooped by the scooping roller 43K and applies the developer onto the developing belt 41. The applying roller 44K is electrically conductive, and a predetermined bias is applied thereto from a power source (not depicted).

Figure 2:
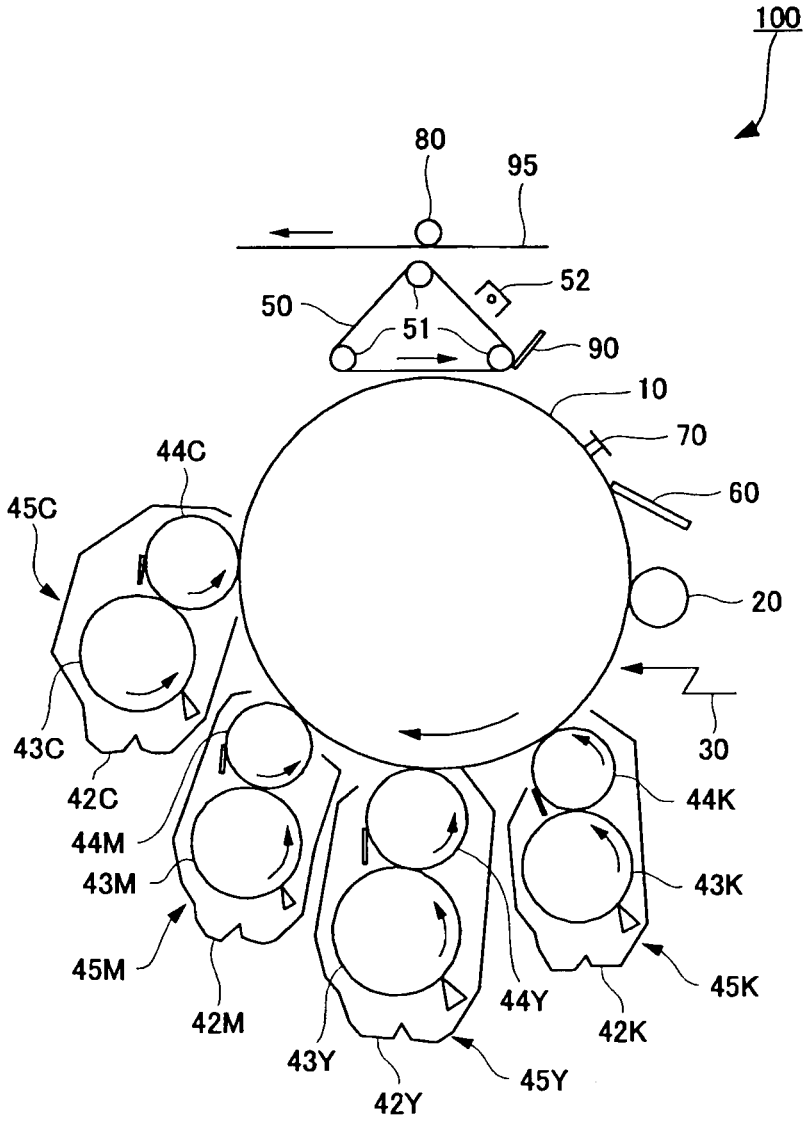
FIG. 2 is a schematic structural diagram showing another embodiment of a copier having an intermediate transfer member.

It should be noted that the device configuration of the copier according to the present embodiment is not confined to such a device configuration as shown in FIG. 1 and may be such a device configuration as shown in FIG. 2 in which the developing units 45 for each color are disposed in the vicinity of the photoconductor 10.

Next, operation of the copier will be explained. In FIG. 1, the photoconductor 10 is uniformly charged by the charging roller 20 while being rotated in the arrow direction, then the exposer 30 projects reflected light from an original document by means of an optical system (not depicted) and forms a latent electrostatic image on the photoconductor 10. This latent electrostatic image is developed by the developing device 40, and a toner image as a visualized image is formed. A thin layer of the developer on the developing belt 41 is released in the form of a thin layer from the developing belt 41 by contact with the photoconductor in a developing region and moved to the portion on the photoconductor 10 where the latent image is formed.

The toner image developed by this developing device 40 is transferred onto the surface of the intermediate transfer member 50 (primary transfer) at a portion (primary transfer region) in which to come into contact with the intermediate transfer member 50 moving at an equal velocity to the photoconductor 10. In the case where three or four colors are transferred and superimposed onto one another, this process is carried out for each color so as to form a color image on the intermediate transfer member 50.

The corona charger 52 for charging the superimposed toner image on the intermediate transfer member is positioned on the downstream side of the contact section between the photoconductor 10 and the intermediate transfer member 50 and also on the upstream side of the contact section between the intermediate transfer member 50 and the transfer paper 100, with respect to the rotational direction of the intermediate transfer member 50.

Then, this corona charger 52 gives the toner image a true charge having the same polarity as that of toner particles forming the toner image, and thus gives the toner image such a sufficient charge as allows it to be favorably transferred onto the transfer paper 100.

After charged by the corona charger 52, the toner image is transferred at one time onto the transfer paper 100 conveyed in the arrow direction from a paper feeder not depicted (secondary transfer) by a transfer bias from the transfer roller 80.

Subsequently, the transfer paper 100 onto which the toner image has been transferred is detached from the photoconductor 10 by a detaching device (not depicted), and it is ejected from the copier after the toner image has been fixed by an image-fixing device (not depicted).

Meanwhile, as for the photoconductor 10 after the transfer, toner particles not transferred therefrom are retrieved and removed by the cleaner 60, and residual charge is eliminated therefrom by the charge-eliminating lamp 70 in preparation for the next charging.

It is desirable that the static friction coefficient of the intermediate transfer member be 0.1 to 0.6, more desirably 0.3 to 0.5. It is desirable that the volume resistance of the intermediate transfer member be in the range of several Ωcm to $10^3$ Ωcm. By setting the volume resistance in the range of several Ωcm to $10^3$ Ωcm, the intermediate transfer member itself can be prevented from being charged, and charge given by a charging unit hardly remains on the intermediate transfer member, so that uneven transfer at the time of secondary transfer can be prevented. In addition, a transfer bias can be easily applied at the time of secondary transfer.

The material for the intermediate transfer member is not particularly limited but able to be selected from all conventional materials. Examples thereof are as follows. (1) Materials with high Young's moduli (tensile elastic moduli) used as single-layer belts, including PC (polycarbonates), PVDF (polyvinylidene fluoride), PAT (polyalkylene terephthalate), blended materials of PC and PAT, blended materials of ETFE (ethylene tetrafluoroethylene copolymer) and PC, blended materials of ETFE and PAT, blended materials of PC and PAT, and thermosetting polyimides of carbon black dispersion. These single-layer belts with high Young's moduli are advantageous in that they do not deform much against stress at the time of image formation, and in that mis-registration is not easily caused especially at the time of color image formation.

(2) Double or triple-layer belts constructed by using the belts with high Young's moduli as base layers and placing surface layers or intermediate layers on the peripheries thereof. These double or triple-layer belts have the function of preventing print defects of unclear central portions in line images that stem from the hardness of the single-layer belts.

(3) Belts with relatively low Young's moduli, using rubbers and elastomers. These belts are advantageous in that their softness makes it possible to substantially prevent print defects of unclear central portions in line images. Moreover, since each belt is made greater in width than a driving roller and a tension roller and prevented from moving zigzag by utilizing the elasticity of a belt edge portion that extends over the rollers, it is possible to reduce costs without using ribs or a device for preventing the belt from moving zigzag.

Although intermediate transfer belts have conventionally been formed of fluorine resins, polycarbonate resins, polyimide resins and the like, elastic belts in which elastic members are used for all layers or partially used have come into use in recent years. Transfer of color images with the use of resin belts has the following problems. A color image is normally formed from four coloring toners. In one color image, four toner layers are formed. The toner layers are pressurized as they undergo the primary transfer (transfer of the toner layers from the photoconductor to the intermediate transfer belt) and the secondary transfer (transfer of the toner layers from the intermediate transfer belt to a sheet), and thus the cohesive force amongst toner particles increases. As the cohesive force amongst toner particles increases, a phenomenon in which central portions of letters/characters and edges of solid images are unclear becomes liable to arise. Since the resin belts are too hard to deform correspondingly to the toner layers, they tend to compress the toner layers, and thus a phenomenon in which central portions of letters/characters are unclear is liable to arise.

Additionally, there has recently been an increased demand for formation of full-color images on a variety of types of paper, for example Japanese paper and paper whose surface is intentionally made rough. However, paper with poor smoothness makes it easier to create gaps between the paper and a toner when the toner is transferred thereto, and thus transfer deficiency is liable to arise. When the transfer pressure of a secondary transfer section is increased to enhance adhesion, the cohesive force of the toner layers is also increased, thereby causing the above-mentioned phenomenon in which central portions of letters/characters are unclear.

The elastic belts are used for the following purpose. Each elastic belt deforms correspondingly to the toner layers and paper with poor smoothness at a transfer section. Specifically, since the elastic belt deforms correspondingly to local bumps and depressions, excellent adhesion can be obtained without excessively increasing the transfer pressure against the toner layers, and it is possible to obtain transferred images having no unclear central portions, that are superior in uniformity even on paper with poor flatness.

Each elastic belt can be formed of one or more materials selected from the group consisting of polycarbonates, fluorine resins (ETFE and PVDF), styrene resins (homopolymers and copolymers including styrene or substitution products thereof) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylic acid ester copolymers (styrene-methyl acrylate copolymer, styrene-ethyl acrylate copolymer, styrene-butyl acrylate copolymer, styrene-octyl acrylate copolymer, styrene-phenyl acrylate copolymer, etc.), styrene-methacrylic acid ester copolymers (styrene-methyl methacrylate copolymer, styrene-ethyl methacrylate copolymer, styrene-phenyl methacrylate copolymer, etc.), styrene-α-methyl chloracrylate copolymer and styrene-acrylonitrile-acrylic acid ester copolymer, methyl methacrylate resin, butyl methacrylate resin, ethyl acrylate resin, butyl acrylate resin, modified acrylic resins (silicone-modified acrylic resin, vinyl chloride resin-modified acrylic resin, acrylic-urethane resin, etc.), vinyl chloride resin, styrene-vinyl acetate copolymer, vinyl chloride-vinyl acetate copolymer, rosin-modified maleic acid resin, phenol resin, epoxy resin, polyester resin, polyester-polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl butyral resin, polyamide resin, modified polyphenylene oxide resin and the like. It should, however, be noted that the elastic belt may be formed of materials other than the above-mentioned materials, of course.

Each of the elastic rubbers and elastomers can be formed of one or more materials selected from the group consisting of butyl rubber, fluorine rubber, acrylic rubber, EPDM (ethylene propylene diene monomer) rubber, NBR (acrylonitrile butadiene rubber), acrylonitrile-butadiene-styrene natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, thermoplastic elastomers (such as polystyrene elastomers, polyolefin elastomers, polyvinyl chloride elastomers, polyurethane elastomers, polyamide elastomers, polyurea elastomers, polyester elastomers and fluorine resin elastomers) and the like. It should, however, be noted that the elastic rubber and the elastomer may be formed of materials other than the above-mentioned materials, of course.

Examples of conductive agents for adjusting resistance values include, but not limited to, carbon black, graphite, metal powders such as aluminum powder and nickel powder, and conductive metal oxides such as tin oxide, titanium oxide, antimony oxide, indium oxide, potassium titanate, antimony tin oxide (ATO) and indium tin oxide (ITO). The conductive metal oxides may be coated with fine insulating particles such as barium sulfate, magnesium silicate and calcium carbonate.

Materials for a surface layer, and the surface layer are required to prevent elastic materials from contaminating the photoconductor and enhance cleaning ability and secondary transfer ability by reducing skin friction drag between the toner and the transfer belt surface and so lessening the adhesion of the toner to the transfer belt surface. For example, one or more types of powders or particles formed of fluorine resin, fluorine compound, carbon fluoride, titanium dioxide, silicon carbide, etc., which are materials for reducing surface energy and enhancing lubrication, can be dispersed into one or more of polyurethane, polyester, epoxy resin and the like. Also, the powders or the particles may differ from one another in particle diameter. Additionally, it is possible to use a material, such as fluorine rubber, which is heat-treated in order that a fluorine-rich layer is formed on the surface thereof and that surface energy can be reduced. It is not that the belts have to be manufactured by a particular manufacturing process.

Examples of manufacturing processes of the belts include, but not limited to, a centrifugal forming process in which material is poured into a rotating cylindrical mold to form a belt, a spray application process in which a liquid paint is sprayed to form a film, a dipping process in which a cylindrical mold is dipped into a solution of material and then pulled out, an injection mold process in which material is injected between an inner mold and an outer mold, and a process in which a compound is applied onto a cylindrical mold and the compound is vulcanized and ground. In general, a plurality of manufacturing processes are combined to manufacture belts.

Examples of methods for preventing elongation of the elastic belt include a method in which to form a rubber layer on a core resin layer that does not elongate much, and a method in which to add an elongation-preventing material into a core layer. It should, however, be noted that these methods are not particularly relevant to the manufacturing processes.

The elongation-preventing core layer is constructed, for example, of one or more materials selected from the group consisting of natural fibers such as cotton and silk; synthetic fibers such as polyester fiber, nylon fiber, acrylic fiber, polyolefin fiber, polyvinyl alcohol fiber, polyvinyl chloride fiber, polyvinylidene chloride fiber, polyurethane fiber, polyacetal fiber, polyfluoroethylene fiber and phenol fiber; inorganic fibers such as carbon fiber, glass fiber and boron fiber; and metal fibers such as iron fiber and copper fiber. And, the layer is in the form of woven cloth or thread. It goes without saying that the layer may be constructed of materials other than the above-mentioned materials.

The thread may be optionally twisted. For example, the thread may be a thread formed by twisting one or more filaments, a single-ply thread, a multi-ply thread or a two-ply thread. Additionally, fibers of different materials selected from the above-mentioned group may be spun together, for example. It goes without saying that the thread can be subjected to a certain process for conductivity.

Meanwhile, the woven cloth may be arbitrarily woven, for example in the form of plain knitting. Of course, it is possible to use a woven cloth in the form of a mixed weave and to make the woven cloth conductive.

It is not that the core layer has to be provided by a particular production process. Examples of production processes thereof include a process in which a cylindrically-woven cloth is laid over a mold or the like and a coating layer is provided thereon, a process in which a cylindrically-woven cloth is dipped in liquid rubber or the like in order that either or both surfaces of the core layer are provided with a coating layer, and a method in which thread is helically wound around a mold or the like at an arbitrary pitch, and a coating layer is provided thereon.

The thickness of an elastic layer may be set depending upon the hardness thereof; nevertheless, if the elastic layer is too thick, the surface greatly elongates and contracts, and thus cracks are liable to arise in the surface layer. Moreover, too much thickness (approximately 1 mm or greater) is not favorable, for example because as the amount of elongation and contraction increases, the extent of elongation and contraction in images becomes greater.

(Tandem Color Image Forming Apparatus)

Figure 3:
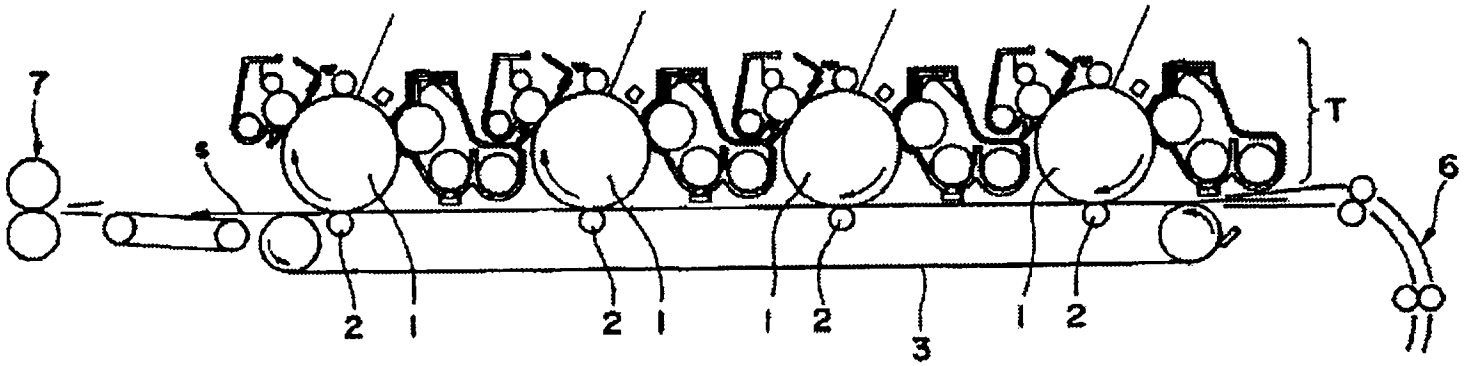
FIG. 3 is a schematic structural diagram showing one embodiment of a tandem color image forming apparatus.
Figure 4:
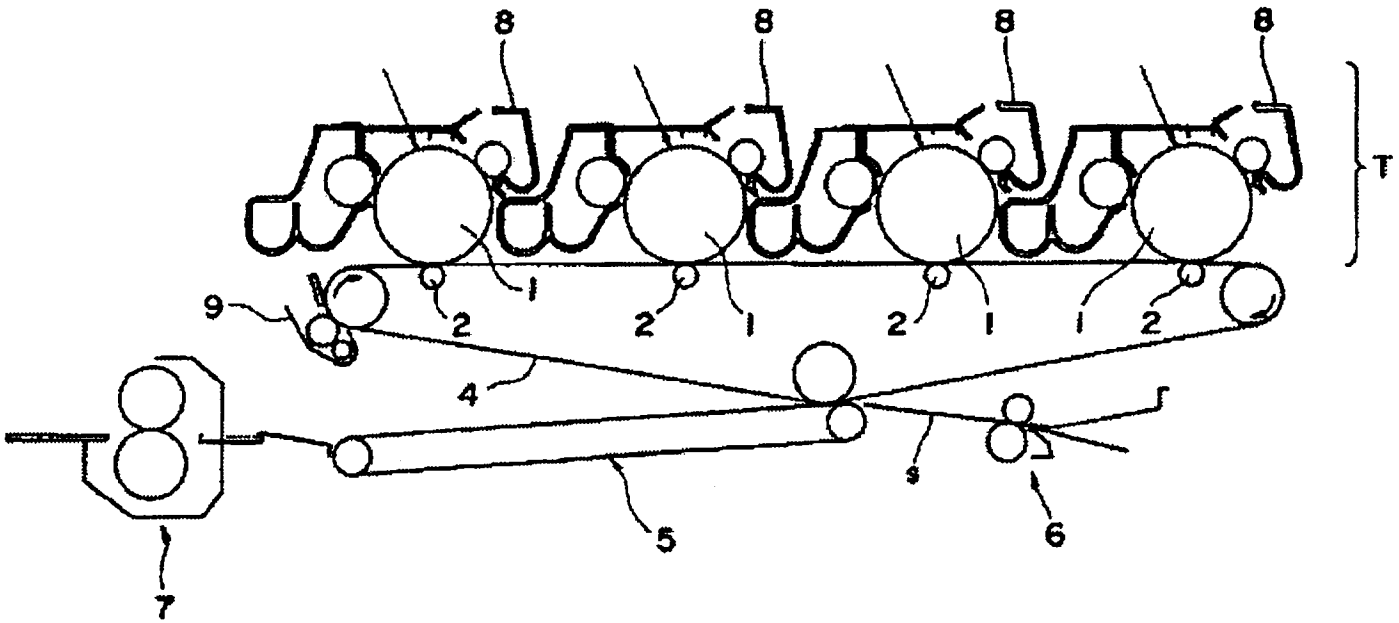
FIG. 4 is a schematic structural diagram showing one embodiment of a tandem color image forming apparatus having an intermediate transfer member.

The toner of the present invention can also be used in a tandem color image forming apparatus. One embodiment of a tandem color image forming apparatus is now explained. Tandem electrophotographic apparatuses are classified into ones of the direct image transfer system in which images on photoconductors 1 are sequentially transferred by transfer devices 2 onto a sheet "s" conveyed by a sheet conveyance belt 3 as shown in FIG. 3, and ones of the indirect image transfer system in which images on photoconductors 1 are sequentially transferred by primary transfer devices 2 onto an intermediate transfer member 4, and then the images on the intermediate transfer member 4 are transferred by a secondary transfer device 5 onto a sheet "s" at one time as shown in FIG. 4. Although the secondary transfer device 5 is an image transfer conveyance belt in this embodiment, it may be a roller.

When a comparison is made between a tandem electrophotographic apparatus of the direct image transfer system and that of the indirect image transfer system, the former has to incorporate a paper feeder 6 on the upstream side of a tandem image forming apparatus T where the photoconductors 1 are arranged, and an image-fixing device 7 on the downstream side thereof, and is therefore disadvantageous in that it is enlarged in the direction of sheet conveyance.

The latter, meanwhile, makes it possible to set a secondary transfer position relatively freely. It is advantageous in that it can be miniaturized because a paper feeder 6 and an image-fixing device 7 can be disposed immediately below a tandem image forming apparatus T.

Also, in order to prevent the former from enlarging in the direction of sheet conveyance, it is necessary to place the image-fixing device 7 close to the tandem image forming apparatus T. For that reason, it is impossible to place the image-fixing device 7 with such a margin as can allow the sheet "s" to bend, and thus the former is disadvantageous in that the image-fixing device 7 is liable to have negative effects on image formation on the upstream side, owing to an impact (which is conspicuous, especially in the case of a thick sheet) created when an end of the sheet "s" enters the image-fixing device 7 and a difference between the sheet conveyance speed at which the sheet passes through the image-fixing device 7 and the sheet conveyance speed of an image transfer conveyance belt.

As opposed to the former, since the latter makes it possible to place the image-fixing device 7 with such a margin as can allow the sheet "s" to bend, it can substantially prevent the image-fixing device 7 from having negative effects on image formation.

Thus, tandem electrophotographic apparatuses of the indirect image transfer system, in particular, are attracting attention these days.

Regarding a color electrophotographic apparatus of this type, as shown in FIG. 4, residual toner that remains on the photoconductors 1 after primary transfer is removed by photoconductor cleaning devices 8 to clean the surfaces of the photoconductors 1 in preparation for next image formation. Also, residual toner that remains on the intermediate transfer member 4 after second transfer is removed by an intermediate transfer member cleaning device 9 to clean the surface of the intermediate transfer member 4 in preparation for next image formation.

Figure 5:
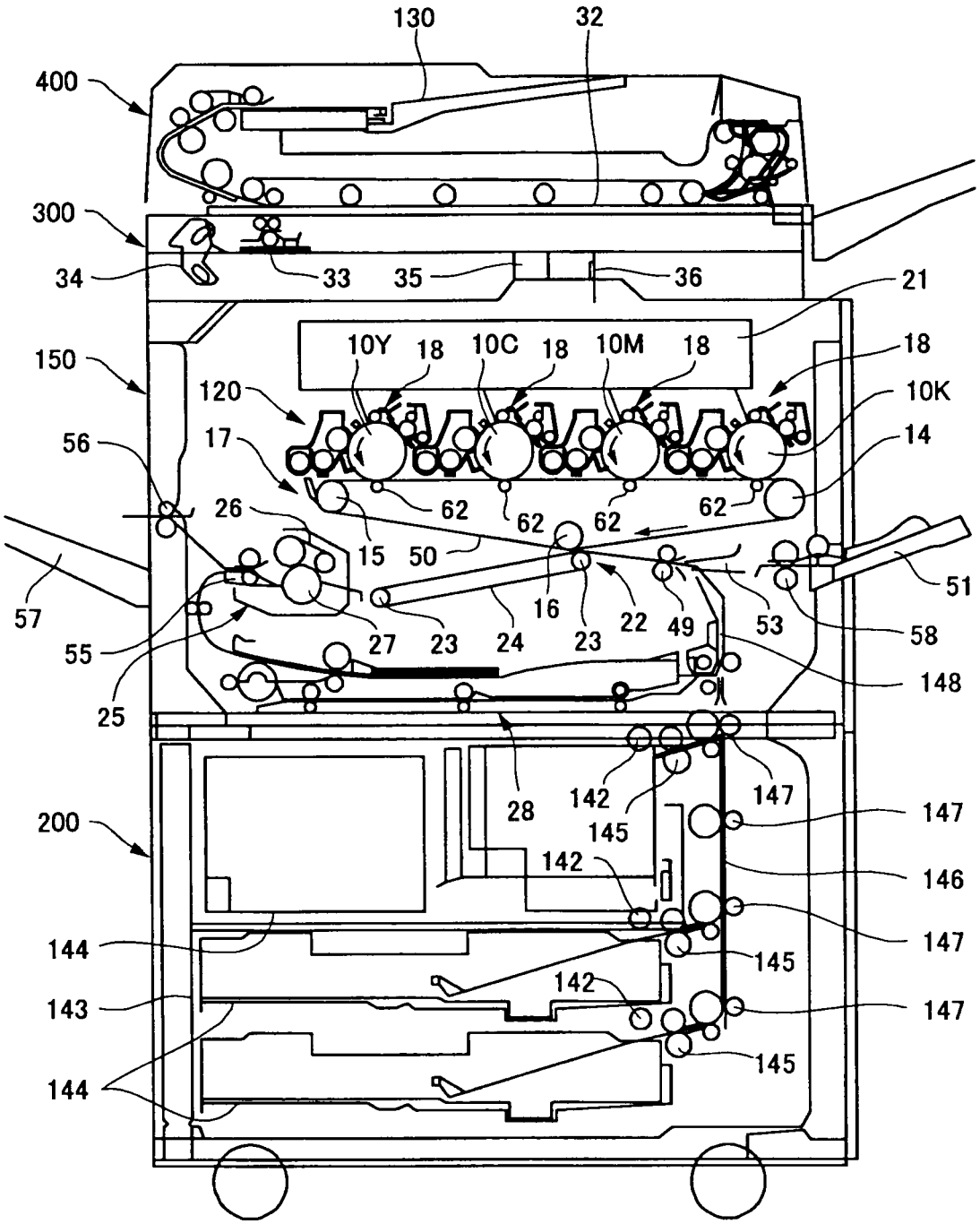
FIG. 5 is a schematic structural diagram showing an overall configuration of the tandem color image forming apparatus in FIG. 4.

FIG. 5 shows a tandem electrophotographic apparatus of the indirect image transfer system according to one embodiment of the present invention. In the figure, regarding the reference numerals, 150 denotes a copier main body, 200 denotes a paper feed table on which the copier main body 150 is mounted, 300 denotes a scanner installed on the copier main body 150, and 400 denotes an automatic document feeder (ADF) installed on the scanner 300.

At the center of the copier main body 150 is provided an intermediate transfer member 50 shaped like an endless belt. In this embodiment, the intermediate transfer member 50 can be rotationally conveyed clockwise, supported by three supporting rollers 14, 15 and 16 as shown in FIG. 5. In this embodiment, an intermediate transfer member cleaning device 17 for removing residual toner that remains on the intermediate transfer member 50 after image transfer is provided on the left-hand side of the second supporting roller 15 amongst the three supporting rollers. Also, in the conveyance direction of the intermediate transfer member 50, four image forming units 18 of yellow, cyan, magenta and black are aligned on the intermediate transfer member 50 placed between the first supporting roller 14 and the second supporting roller 15 amongst the three supporting rollers, and a tandem image forming apparatus 120 is thus constructed.

On the tandem image forming apparatus 120 is provided an exposer 21 as shown in FIG. 5. Meanwhile, a secondary transfer device 22 is provided on the opposite side to the tandem image forming apparatus 120 with respect to the intermediate transfer member 50. In this embodiment, the secondary transfer device 22 includes two rollers 23 and a secondary transfer belt 24 supported by the rollers 23, and is pressed against a third supporting roller 16 with the intermediate transfer member 50 placed in between, so as to allow an image on the intermediate transfer member 50 to be transferred onto a sheet.

An image-fixing device 25 for fixing the transferred image on the sheet is provided next to the secondary transfer device 22. The image-fixing device 25 includes a fixing belt 26, which is an endless belt, and a pressurizing roller 27 pressed against the fixing belt 26. The secondary transfer device 22 is also provided with a sheet conveying function whereby a sheet onto which an image has been transferred is conveyed to this image-fixing device 25. It goes without saying that a transfer roller or a noncontact charger may be provided for the secondary transfer device 22, in which case, however, this sheet conveying function is difficult to add.

Additionally, in this embodiment, under the secondary transfer device 22 and the image-fixing device 25, a sheet upending device 28 configured to upend a sheet so as to record an image on both sides of the sheet is provided parallel with the tandem image forming apparatus 120.

Incidentally, when a copy is made using this color electrophotographic apparatus, a document is set on a document stand 130 in the automatic document feeder 400. Alternatively, the automatic document feeder 400 is opened so as to set a document on a contact glass 32 of the scanner 300, then the automatic document feeder 400 is closed to press the document. When a start switch (not depicted) is pushed, the scanner 300 is driven and a first running member 33 and a second running member 34 are moved, after the document is conveyed onto the contact glass 32 in the case where the document is set in the automatic document feeder 400, or immediately in the case where the document is set on the contact glass 32. Then the first running member 33 allows light to be emitted from a light source and it also reflects light coming from the document surface and directs the light toward the second running member 34. The light is then reflected by a mirror of the second running member 34 and captured into a reading sensor 36 through an image forming lens 35, and the content of the document is thus read.

Also, when the start switch (not depicted) is pushed, a drive motor (not depicted) rotationally drives one of the supporting rollers 14, 15 and 16, thereby making the rest of the supporting rollers also rotate following the rotation thereof, and the intermediate transfer member 50 is thus rotationally conveyed. At the same time, the image forming units 18 respectively rotate photoconductors 10 to form monochrome images of black, yellow, magenta and cyan on the photoconductors 10. Then as the intermediate transfer member 50 is conveyed, those monochrome images are sequentially transferred onto the intermediate transfer member 50 to form a composite color image there.

Meanwhile, when the start switch (not depicted) is pushed, one of paper feed rollers 142 of the paper feed table 200 is selectively rotated, and sheets are ejected from one of multiple paper feed cassettes 144 in a paper bank 143 and separated by a separation roller 145 one by one into a paper feed path 146. Then the sheets are conveyed by a conveyance roller 147 into a paper feed path 148 in the copier main body 150 and bumped against a resist roller 49.

Alternatively, the paper feed rollers are rotated to eject sheets from a manual bypass tray 51, and the sheets are separated by a separation roller 58 one by one into a manual bypass paper feed path 53 and bumped against the resist roller 49 as well.

The resist roller 49 is rotated synchronously with the movement of the composite color image on the intermediate transfer member 50 to pass a sheet between the intermediate transfer member 50 and the secondary transfer device 22, and the composite color image is transferred onto the sheet by the secondary transfer device 22 and thus recorded thereon.

The sheet onto which the image has been transferred is conveyed by the secondary transfer device 22 to the image-fixing device 25 where the transferred image is fixed by means of heat and pressure, and then the sheet is ejected by an ejecting roller 56 with its moving direction changed by a switch blade 55, and is finally placed on an output tray 57. Alternatively, with its moving direction changed by the switch blade 55, the sheet is carried into the sheet upending device 28 where it is upended, and the sheet is transported again to the transfer position so as to record an image on its back surface as well, and then ejected onto the output tray 57 by the ejecting roller 56.

As for the intermediate transfer member 50 after the image transfer, residual toner that remains thereon is removed by the intermediate transfer member cleaning device 17 after the image transfer, in preparation for the next image formation by the tandem image forming apparatus 120.

Here, the resist roller 49 is generally grounded, but it is also acceptable to apply a bias thereto for removal of paper dust on the sheet.

Figure 6:
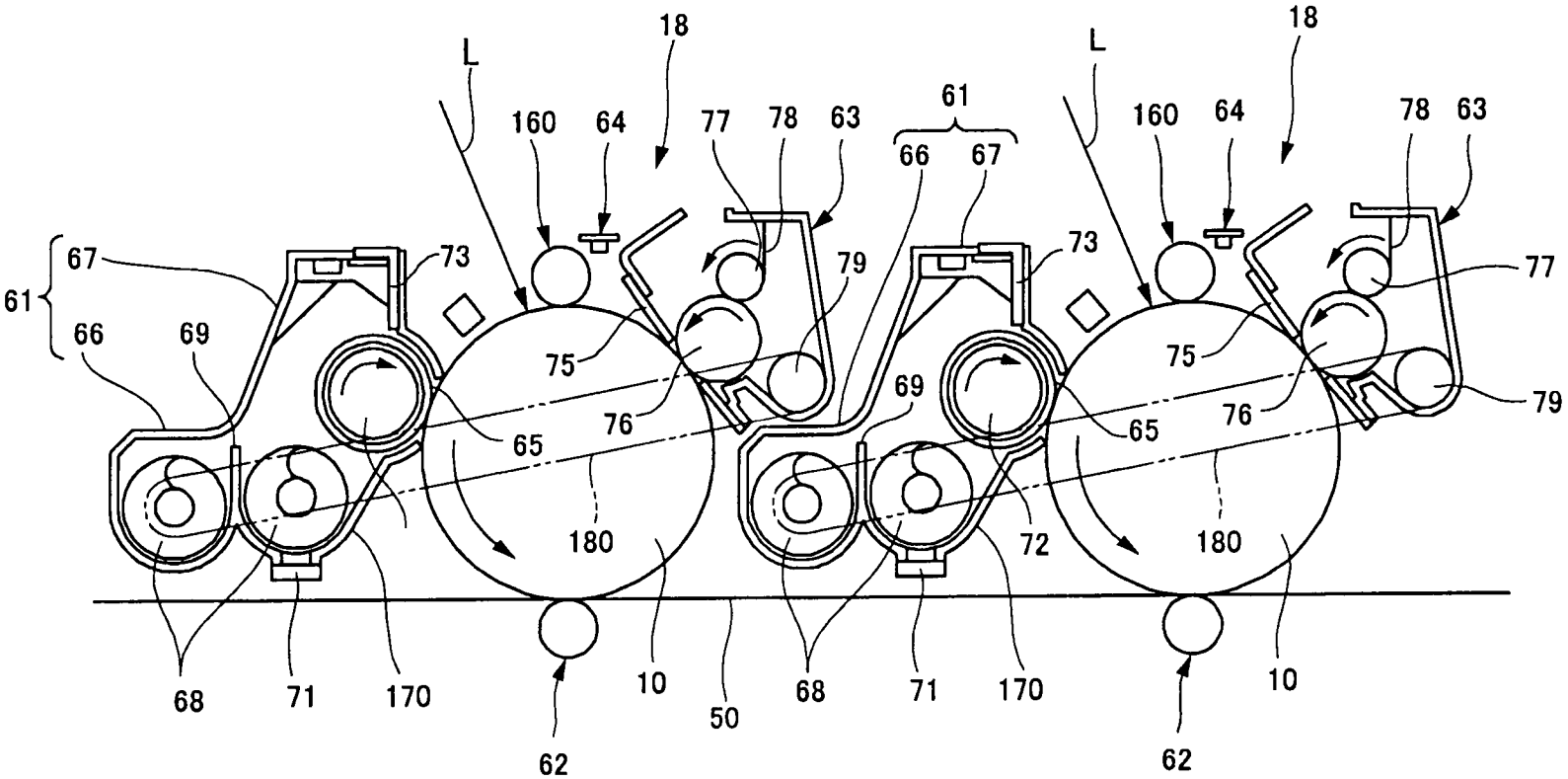
FIG. 6 is a diagram partially showing details of the tandem color image forming apparatus in FIG. 4.

Incidentally, in the tandem image forming apparatus 120, each of the image forming units 18 includes a charger 160, a developing device 61, a primary transfer device 62, a photoconductor cleaning device 63, a charge-eliminator 64 and the like in the vicinity of the drum-shaped photoconductor 10 as shown, for example, in FIG. 6.

EXAMPLES

The following further explains the present invention by means of Examples; however, it should be noted that the present invention is not confined to these Examples. In the Examples, the term "part" denotes part by mass.

Production Example 1

Synthesis of Fine Organic Particle Emulsion

In a reaction container equipped with a stirrer and a thermometer, 683 parts of water, 11 parts of sodium salt of ethylene oxide methacrylate adduct sulfate (ELEMINOL RS-30 produced by Sanyo Chemical Industries, Ltd.), 166 parts of methacrylic acid, 110 parts of butyl acrylate and 1 part of ammonium persulfate were placed, then these ingredients were stirred at 3,800 rpm for 30 min to give a white emulsion. The white emulsion was heated until the temperature in the system became 75° C., and was subjected to reaction for 4 hr. Further, the white emulsion was provided with 30 parts of 1% ammonium persulfate solution and ripened at 75° C. for 6 hr to yield an aqueous dispersion solution [fine particle dispersion solution 1] of a vinyl resin (copolymer of methacrylic acid, butyl acrylate and sodium salt of ethylene oxide methacrylate adduct sulfate). The volume average particle diameter of [fine particle dispersion solution 1] measured by a laser diffraction particle size analyzer LA-920 was 110 nm. A resin content was isolated from [fine particle dispersion solution 1] by drying part of [fine particle dispersion solution 1]. The resin content had a Tg of 58° C. and a weight average molecular weight of 130,000.

Preparation of Aqueous Phase

A milky-white solution was obtained by mixing and stirring 990 parts of water, 83 parts of [fine particle dispersion solution 1], 37 parts of 48.3% solution of sodium dodecyl diphenyl ether disulfonate (ELEMINOL MON-7 produced by Sanyo Chemical Industries, Ltd.) and 90 parts of ethyl acetate. To this milky-white solution were added 10 parts of fine styrene-butyl acrylate particles having a weight average diameter of 110 nm (weight average molecular weight of 120,000) produced as protrusion-forming fine resin particles A by means of soap-free emulsion polymerization, and the mixture was stirred and dispersed by a homogenizer. The obtained solution was filtered through a stainless mesh of 28 μm in sieve mesh size, and coarse matter was removed. This product is referred to as [aqueous phase 1].

Synthesis of Low-Molecular Polyester

In a reaction container equipped with a cooling tube, a stirring device and a nitrogen-introducing tube, 229 parts of an ethylene oxide (2 mol) adduct of bisphenol A, 529 parts of a propylene oxide (3 mol) adduct of bisphenol A, 208 parts of terephthalic acid, 46 parts of adipic acid and 2 parts of dibutyltin oxide were placed, and these ingredients were subjected to reaction at 230° C. and at normal pressure for 7 hr, then at a reduced pressure of 10 mmHg to 15 mmHg for 5 hr. Thereafter, 44 parts of trimellitic anhydride were added into the reaction container, and the mixture was subjected to reaction at 180° C. and at normal pressure for 3 hr to yield [low-molecular polyester 1]. [Low-molecular polyester 1] had a number average molecular weight of 2,300, a weight average molecular weight of 6,700, a Tg of 43° C. and an acid value of 25.

Synthesis of Intermediate Polyester

In a reaction container equipped with a cooling tube, a stirring device and a nitrogen-introducing tube, 682 parts of an ethylene oxide (2 mol) adduct of bisphenol A, 81 parts of a propylene oxide (2 mol) adduct of bisphenol A, 283 parts of terephthalic acid, 22 parts of trimellitic anhydride and 2 parts of dibutyltin oxide were placed, and these ingredients were subjected to reaction at 230° C. and at normal pressure for 7 hr, then at a reduced pressure of 10 mmHg to 15 mmHg for 5 hr to yield [intermediate polyester 1]. [Intermediate polyester 1] had a number average molecular weight of 2,200, a weight average molecular weight of 9,700, a Tg of 54° C., an acid value of 0.5 and a hydroxyl value of 52.

Next, in a reaction container equipped with a cooling tube, a stirring device and a nitrogen-introducing tube, 410 parts of [intermediate polyester 1], 89 parts of isophorone diisocyanate and 500 parts of ethyl acetate were placed, and these ingredients were subjected to reaction at 100° C. for 5 hr to yield [prepolymer 1]. Free isocyanate of [Prepolymer 1] was 1.53% by mass.

Synthesis of Ketimine

In a reaction container equipped with a stirrer and a thermometer, 170 parts of isophoronediamine and 75 parts of methyl ethyl ketone were placed, and these ingredients were subjected to reaction at 50° C. for 4.5 hr to yield [ketimine compound 1]. The amine value of [ketimine compound 1] was 417.

Synthesis of Masterbatch (MB)

[Masterbatch 1] was yielded as follows: 1,200 parts of water, 540 parts of carbon black (Printex 35 produced by Degussa GmbH) (DBP oil absorption=42 ml/100 mg, pH=9.5) and 1,200 parts of polyester resin were mixed using HENSCHEL MIXER (produced by Mitsui Mining Co., Ltd.), and the mixture was kneaded at 110° C. for 1 hr using two rollers; thereafter, the mixture was cooled while extended under pressure, and was pulverized with a pulverizer.

Production of Oil Phase

In a container equipped with a stirrer and a thermometer, 378 parts of [low-molecular polyester 1], 100 parts of carnauba wax and 947 parts of ethyl acetate were placed, and these ingredients were heated to 80° C. while stirred, and were left to stand at 80° C. for 5 hr and then cooled to 30° C. in 1 hr. Subsequently, 500 parts of [masterbatch 1] and 500 parts of ethyl acetate were added into the container and mixed for 1 hr to yield [raw material solution 1].

Next, 1,324 parts of [raw material solution 1] were moved to a container, and 2 parts of fine hydrophobic silica particles (12 nm) were added thereto. Then carbon black and wax were dispersed into the ingredients under the conditions of a solution feed rate of 1 kg/hr, a disk circumferential velocity of 6 m/sec, supply of 0.5 mm zirconia beads by 80 vol. % and three passes, using a bead mill (ULTRA VISCO MILL produced by IMEX Co., Ltd.). Thereafter, with addition of 1,324 parts of a 65% ethyl acetate solution of [low-molecular polyester 1], the ingredients underwent two passes with the bead mill under the above-mentioned conditions to yield [pigment-wax dispersion solution 1]. The solid content concentration (130° C., 30 min) of [pigment-wax dispersion solution 1] was 50%.

Emulsification→Removal of Solvent

In a container, 749 parts of [pigment-wax dispersion solution 1], 115 parts of [prepolymer 1] and 2.9 parts of [ketimine compound 1] were placed, and the ingredients were mixed at 5,000 rpm for 2 min by TK HOMOMIXER (produced by Tokushukika Kogyo Co., Ltd.). Thereafter, with addition of 1,200 parts of [aqueous phase 1] into the container, the ingredients were mixed at 13,000 rpm for 25 min by TK HOMOMIXER to yield [emulsified slurry 1].

In a container equipped with a stirring device and a thermometer, [emulsified slurry 1] was placed, and after solvent was removed at 30° C. for 8 hr, the product was ripened at 40° C. for 24 hr to yield [dispersion slurry 1].

Washing→Drying

After 100 parts of [dispersion slurry 1] were filtered under reduced pressure, (1) 100 parts of ion-exchange water were added to a filter cake, and these were mixed by TK HOMOMIXER (at 12,000 rpm for 10 min) and then filtered.

(2) 100 parts of 10% sodium hydroxide solution were added to the filter cake of (1), and these were mixed by TK HOMOMIXER (at 12,000 rpm for 30 min) and then filtered under reduced pressure.

(3) 100 parts of 10% hydrochloric acid were added to the filter cake of (2), and these were mixed by TK HOMOMIXER (at 12,000 rpm for 10 min) and then filtered.

(4) 100 parts of ion-exchange water were added to the filter cake of (3), a solution containing a fluorine-based surfactant equivalent to 0.1% by mass of the solid content of the cake was also added, and these were mixed by TK HOMOMIXER (at 12,000 rpm for 10 min) and then filtered.

(5) 300 parts of ion-exchange water were added to the filter cake of (4), and these were mixed by TK HOMOMIXER (at 12,000 rpm for 10 min) and then filtered twice to yield [filter cake 1].

[filter cake 1] was dried by a circulation dryer at 45° C. for 48 hr. Afterward, [filter cake 1] was filtered through a mesh of 75 μm in sieve mesh size to yield [particles 1 having protruding portions on surfaces of toner base particles].

Production Examples 2 to 5

Particles 2 to 5 having protruding portions on surfaces of toner base particles were obtained in a manner similar to the particles 1 in Production Example 1, except that the protrusion-forming fine resin particles A added into the aqueous phase in production Example 1 were changed as shown in Table 1.

Production Example 6

Toner base particles 6 were obtained in a manner similar to the particles 1 in Production Example 1, except that the protrusion-forming fine resin particles A added into the aqueous phase in production Example 1 were not used.

(Production of Carrier)

| Core material | |
|---|---|
| Mn ferrite particles (weight average diameter: 35 μm) | 5,000 parts |
| Coating materials | |
| toluene | 200 parts |
| silicone resin SR2400 (produced by Dow Corning Toray Co., Ltd., nonvolatile content: 50%) | 200 parts |
| AMINOSILANE SH6020 (produced by Dow Corning Toray Co., Ltd.) | 7 parts |
| carbon black | 4 parts |

A coating solution was prepared by dispersing the above-mentioned coating materials for 10 min using a stirrer. This coating solution and the core material were poured into a coating apparatus in which a rotary bottom plate disk and an stirring blade were provided in a fluidized bed and coating was performed by forming a swirling flow, and the coating solution was thus applied onto the core material. The applied product was embedded in an electrical furnace at 250° C. for 2 hr to yield a carrier.

(Mixing of External Additive)

Toner particles were obtained by mixing 1.5 parts of hydrophobic silica particles of 12 nm in diameter and 0.75 parts of fine hydrophobic titanium oxide particles of 16 nm in diameter as an external additive with 100 parts of the particles obtained in Production Examples. The external additive was mixed by HENSCHEL MIXER.

(Removal of Coarse Particles)

The amount of coarse particles in the toner was controlled in accordance with the following steps. The mesh herein used was a stainless steel wire formed into a twilled mesh prescribed by JIS (Japanese Industrial Standards). Particles were measured for diameter and sphericity in the following manner.

Flow particle image analyzer FPIA-2100 produced by TOA Medical Electronics Co., Ltd. was used. For the measurement, minute dusts were removed using a filter, and a product was used which had been prepared by adding a few drops of a nonionic surfactant (preferably CONTAMINON N produced by Wako Pure Chemical Industries, Ltd.) to 10 ml of water in which the number of particles present in a measurement range (for example, 0.60 μm or greater and less than 159.21 μm in circle-equivalent diameter) in $10^{-3}$ $cm^3$ of water is 20 or less. Further, 5 mg of a measurement sample was added, and a dispersing process was conducted for 1 min under the conditions of 20 kHz and 50 W/10 $cm^3$ using ultrasonic disperser UH-50 produced by STM Corporation and then conducted again for a total of 5 min to yield a sample dispersion solution in which the particle concentration of the measurement sample was 4,000/$10^{-3}$ $cm^3$ to 8,000/$10^{-3}$ $cm^3$ (particles in the measurement circle-equivalent diameter range are relevant). By using this sample dispersion solution, the particle size distribution of particles which are 0.60 μm or greater and less than 159.21 μm in circle-equivalent diameter was measured.

The sample dispersion solution was passed through a flow path (which widens in the flow direction) of a flat transparent flow cell (approximately 200 μm in thickness). Since the measurement was conducted by means of a light path which intersected the thickness of the flow cell, a stroboscopic light source and a CCD camera were placed opposite each other with respect to the flow cell. While the sample dispersion solution was flowing, a strobe light was applied at intervals of 1/30 sec to obtain particle images. The particles were photographed in the form of two-dimensional images having certain ranges that were parallel to the flow cell. The diameters of circles having the same areas as those of the two-dimensional images of the particles photographed were calculated as circle-equivalent diameters.

By using the sample dispersion liquid of the above-mentioned concentration, it was possible to measure the circle-equivalent diameters of over 1,200 particles in 1 min, and to measure the number of particles based upon a circle-equivalent diameter distribution, and the ratio (number %) of particles having prescribed circle-equivalent diameters. As shown in Table 1, the results (frequency percentage and cumulative percentage) were able to be obtained, with the range of 0.06 μm to 400 μm being divided into 226 channels (divided into 30 channels per octave). In practice, particles are measured, with their circle-equivalent diameters being 0.60 μm or greater and less than 159.21 μm.

The weight average diameter obtained by the measuring apparatus is abbreviated as "Dv".

Toners A to F were yielded by using the particles 1 to 5 having protruding portions on surfaces of toner base particles, and the toner base particles 6 not containing the protrusion-forming fine resin particles A, which serve as a control.

TABLE 1

| | | Protrusion-forming fine resin particles A | | |
|---|---|---|---|---|
| | | Kind | Primary particle diameter (nm) | Added amount (with respect to aqueous phase amount) (part) |
| Production Example 1 | Toner A | fine styrene-butyl acrylate particles | 110 | 10 |
| Production Example 2 | Toner B | fine styrene-butyl acrylate particles | 340 | 7 |
| Production Example 3 | Toner C | fine styrene-butyl acrylate particles | 520 | 7 |
| Production Example 4 | Toner D | fine styrene-butyl acrylate particles | 520 | 10 |
| Production Example 5 | Toner E | fine styrene-butyl acrylate particles | 710 | 6 |
| Production Example 6 | Toner F | — | — | — |

<Evaluation of Two-Component Developer>

Developers were produced by evenly mixing 7 parts of each of the toners in Table 1 and 100 parts of the carrier obtained in the production example of a carrier, using a type of Turbula mixer in which agitation is conducted as a container rotationally moves, and then charging the mixture.

These developers were supplied to IPSIO COLOR 2500 produced by Ricoh Company, Ltd., and images were output. As to the images, initial images were output, and also images were output after the toner supply mechanism had been stopped and 3,000 blank images had been output. The initial images, and the images produced after the 3,000 blank images were evaluated as follows.

The toners used and the evaluation results are shown in Table 2.

(1) Image Density

After solid images had been output onto sheets of transfer paper (TYPE 6200 produced by Ricoh Company, Ltd.) made of plain paper, with the attached amount of each solid image being 0.3±0.1 mg/cm$^2$, the image density of each solid image was measured by X-Rite (produced by X-Rite, Inc.). Images which were 1.4 or greater in image density were evaluated as A, while images which were less than 1.4 in image density were evaluated as B.

(2) Cleaning Ability

Residual toners that remained on cleaned photoconductors after 1,000 charts having an image area ratio of 95% had been output were moved onto blank sheets of paper using SCOTCH TAPE (produced by Sumitomo 3M Limited), and measured for density using Macbeth reflection densitometer RD514. Residual toners having densities that are different from the density of the blank sheets by less than 0.005 were evaluated as A, those having densities that are different by 0.005 to 0.010 were evaluated as B, those having densities that are different by 0.011 to 0.02 were evaluated as C, and those having densities that are different by over 0.02 were evaluated as D.

(3) Transfer Deficiency

Images were formed as follows: the concentration of the images was suitably adjusted such that the attached amount of the images became 0.4±0.1 mg/cm$^2$, and image charts, each of which included 1 cm×1 cm solid images distributed all over an A4 image such that the image area ratio became 25%, were used. As the main apparatus was switched off in the midst of the image formation, images on photoconductors and on an intermediate transfer member were visually observed. While observing twenty 1 cm×1 cm solid images, the number of transfer-deficient portions, which were dotted therein, of 0.5 mm or greater in diameter was counted. Toners with this number being 0 to 1 were evaluated as A, those with this number being 2 to 10 were evaluated as B, those with this number being 10 to 20 were evaluated as C, and those with this number being over 20 were evaluated as D.

(4) Uneven Transfer

Images were formed using image charts, each of which included 1 cm×1 cm solid images distributed all over an A4 image of 2×2 600 dpi. As the main apparatus was switched off in the midst of the image formation, images on the photoconductors and on the intermediate transfer member were visually observed and classified into the four grades.

TABLE 2

| | | | | Initial stage | | | | After passage of 3,000 blank sheets | | | |
|---|---|---|---|---|---|---|---|---|---|---|---|
| | | Dv (um) | Sphericity | Image density | Cleaning ability | Transfer deficiency | Uneven transfer | Image density | Cleaning ability | Transfer deficiency | Uneven transfer |
| Example 1 | Toner A | 5.8 | 0.973 | B | C | B | B | C | C | C | C |
| Example 2 | Toner B | 5.8 | 0.967 | B | C | C | B | C | C | C | C |
| Example 3 | Toner C | 5.6 | 0.966 | B | A | B | B | B | B | B | C |
| Example 4 | Toner D | 6.1 | 0.964 | A | A | B | B | A | A | B | B |
| Example 5 | Toner E | 5.8 | 0.962 | A | A | B | A | B | A | B | A |
| Comparative Example 1 | Toner F | 5.5 | 0.976 | B | D | D | A | D | D | D | B |

Table 2 shows that particles having protrusions in which fine resin particles are borne on surfaces of particles are superior in image-forming properties and hardly become poor in quality throughout their long-term use.

What is claimed is:

1. A toner for developing latent electrostatic images, comprising:

base particles including a colorant and a resin, and hard fine particles, wherein the hard fine particles exist on a surface of the base particles, protruding portions formed of fine organic resin particles which are different in composition from a resin contained as a main component in the base particles are provided on surfaces of the base particles, the main component in the base particles is a polyester resin and the fine organic resin particles are vinyl series resin, wherein the toner is obtained by forming a liquid droplet by dispersing an oil phase, which is produced by dissolving or dispersing a toner material including polyester resin in an organic medium, in an aqueous medium comprising fine organic resin particles forming the protruding portions, wherein a volume average diameter of the toner Dv is 2 μm to 7 μm, and a primary diameter of the fine organic resin particle is 520 nm to 710 nm.

2. The toner for developing latent electrostatic images according to claim 1, wherein the fine organic resin particles have a diameter which is equal to or less than ⅕ the average particle diameter of the toner and have hemispherical convex portions.

3. A two-component developer comprising:

the toner as claimed in claim 1, and a carrier composed of magnetic particles.

4. An image forming method comprising:

forming a toner image by developing a latent electrostatic image on an electrostatic image-bearing member with a developer, bringing a transfer unit into contact with a surface of the electrostatic image-bearing member via a transfer material, and electrostatically transferring the toner image onto the transfer material, wherein the developer is a two-component developer containing the toner as claimed in claim 1, and a carrier composed of magnetic particles.

5. The toner according to claim 1, wherein the primary diameter of the fine organic resin particle is 520 nm to 710 nm.

6. The toner according to claim 1, wherein protrusion-forming fine resin particles comprise styrene-butyl acrylate.

7. The toner according to claim 6, wherein protrusion-forming fine resin particles further comprise fine resin particles which are different from styrene-butyl acrylate.

* * * * *